US011367977B2

(12) United States Patent
Boruszewski et al.

(10) Patent No.: US 11,367,977 B2
(45) Date of Patent: Jun. 21, 2022

(54) SEALED ELECTRICAL CONNECTOR SYSTEM

(71) Applicant: Molex, LLC, Lisle, IL (US)

(72) Inventors: Katy Boruszewski, Auburn Hills, MI (US); Dawson James Schiller, Auburn Hills, MI (US); Dakota R. Barthlow, Auburn Hills, MI (US); Michael Vanslambrouck, Ray Township, MI (US)

(73) Assignee: Molex, LLC, Lisle, IL (US)

( * ) Notice: Subject to any disclaimer, the term of this patent is extended or adjusted under 35 U.S.C. 154(b) by 100 days.

(21) Appl. No.: 16/979,537

(22) PCT Filed: Mar. 15, 2019

(86) PCT No.: PCT/US2019/022393
§ 371 (c)(1),
(2) Date: Sep. 10, 2020

(87) PCT Pub. No.: WO2019/178434
PCT Pub. Date: Sep. 19, 2019

(65) Prior Publication Data

US 2020/0412048 A1 Dec. 31, 2020

Related U.S. Application Data

(60) Provisional application No. 62/644,171, filed on Mar. 16, 2018.

(51) Int. Cl.
*H01R 13/52* (2006.01)
*H01R 13/506* (2006.01)
*H01R 13/6581* (2011.01)

(52) U.S. Cl.
CPC ..... *H01R 13/5208* (2013.01); *H01R 13/506* (2013.01); *H01R 13/6581* (2013.01)

(58) Field of Classification Search
CPC ..... H01R 13/5208; H01R 13/6581; H01R 13/506; H01R 13/5221; H01R 13/5202; H01R 13/521; H01R 13/5219
See application file for complete search history.

(56) References Cited

U.S. PATENT DOCUMENTS 6,116,938 A * 9/2000 Myer ..... H01R 13/6272 439/271
6,364,692 B1 * 4/2002 Okayasu ..... H01R 13/5219 439/204

(Continued)

FOREIGN PATENT DOCUMENTS

| | | | |
|---|---|---|---|
| CN | 203119191 | U | 8/2013 |
| CN | 106716732 | A | 5/2017 |
| JP | 2007-005012 | A | 1/2007 |

OTHER PUBLICATIONS

Office Action received for CN Application No. 201980019668.1, dated Apr. 25, 2021, 18 Pages (10 Pages of English Translation and 8 Pages of Official notification).

(Continued)

*Primary Examiner* — Briggitte R. Hammond

(57) ABSTRACT

A sealed electrical connector system has a first connector assembly and a second connector assembly which are mated together at front ends thereof. In an embodiment, each assembly includes an insulative outer housing, shield seal cap, and terminal housing and an elastomeric shield seal and mat seal, each having terminal receiving passageways through which a terminal is seated. The shield seal caps are attached to rear ends and hold the shield seals in the outer housings. In an embodiment, the second connector assembly includes an insulative outer housing and an elastomeric seal, each having terminal receiving passageways through which a terminal is seated. The shield seal prevents high-pressure spray from directly contacting the mat seal.

20 Claims, 30 Drawing Sheets

(56) References Cited

U.S. PATENT DOCUMENTS

| | | | | |
|---|---|---|---|---|
| 6,739,908 | B2 * | 5/2004 | Hamai ..... | H01R 13/6278<br>439/275 |
| 7,387,545 | B2 | 6/2008 | Tyler et al. | |
| 2002/0086575 | A1 | 7/2002 | Marpoe, Jr. et al. | |
| 2010/0227494 | A1 | 9/2010 | Tyler et al. | |
| 2012/0015537 | A1 | 1/2012 | Park | |
| 2016/0285197 | A1 | 9/2016 | Ghannam et al. | |

OTHER PUBLICATIONS

International search report and written opinion received for PCT application No. PCT/US2019/022393, dated Jul. 3, 2019, 9 pages.

* cited by examiner

SEALED ELECTRICAL CONNECTOR SYSTEM

RELATED APPLICATIONS

This application is a national stage of International Application No. PCT/US2019/022393, filed Mar. 15, 2019, which claims the domestic benefit of U.S. Provisional Application Ser. No. 62/644,171, filed on Mar. 16, 2018, the contents of which are incorporated herein in their entirety.

TECHNICAL FIELD

The disclosure generally relates to a sealed electrical connector system, and more particularly relates to a sealed electrical connector system having a moisture and debris barrier.

DESCRIPTION OF RELATED ART

Waterproof electrical connector systems are conventionally used, for example, for electrical connections in automobiles.

Typically, a waterproof electrical connector system includes a seal having a plurality of electrical wire insertion holes extending between two main surfaces of a substantially circular flat, plate-shaped main body of the seal. A plurality of ring-shaped sealing projections are provided on an inner wall surface of each electrical wire insertion hole for mating with a corresponding wire to deter the passage of moisture and debris therethrough. The seal is mounted in a seal receiving cavity of a housing of the waterproof connector. An outer circumferential surface of the main body of the seal contacts and presses against an inner circumferential surface of the seal member receiving cavity, and a seal is formed between the outer circumferential surface and the inner circumferential surface to deter the passage of moisture and debris therethrough. This arrangement provides a moisture and debris barrier between the wires inserted through the insertion holes and the seal and also between the exterior of the seal and the housing.

When the electrical connector system is subjected to a high-pressure spray (high pressure spray consists of a pressure of 90 bar that is spraying the electrical connector system at approximately a distance of 100 mm), a direct spray on a standard silicone seal of any type can cause failure as the spray bypasses the seal and enters the internal components of the electrical connector system. Typical electrical connector system designs are not able to deflect the pressure hitting the seal because a terminal housing in the electrical connector system must have cavity openings to allow installation and servicing on the terminals and wire assembly. One common technique to solve this issue is to add a wire dress cover or a back shell to the back of the electrical connector system. This must be installed after the terminals are assembled and must be done by the harness manufacturer, which leads to increased costs of manufacture.

BRIEF SUMMARY

The present disclosure generally relates to a sealed electrical connector system that includes a housing and a plurality of wire terminated electrical terminals disposed and retained within the housing. The terminals are sealed to the housing by a primary seal mounted in the housing. A secondary seal is disposed at a wire exit portion of the sealed electrical connector system to increase sealing performance.

The present disclosure further generally relates to a sealed electrical connector system having a first connector assembly and a second connector assembly which are mated together at front ends thereof. In an embodiment, each assembly includes an insulative outer housing, shield seal cap, and terminal housing and an elastomeric shield seal and mat seal, each having terminal receiving passageways through which a terminal is seated. The shield seal caps are attached to rear ends of the outer housing and hold the shield seals in the outer housings. In an embodiment, the second connector assembly includes an insulative outer housing and an elastomeric seal, the outer housing having terminal receiving passageways through which a terminal is seated. The mat seal forms the primary seal which prevents the entry of moisture and debris from passing though the electrical connector system and which achieves standard sealing (S2) performance. The shield seal forms a secondary seal to prevent high-pressure spray from directly contacting the mat seal.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
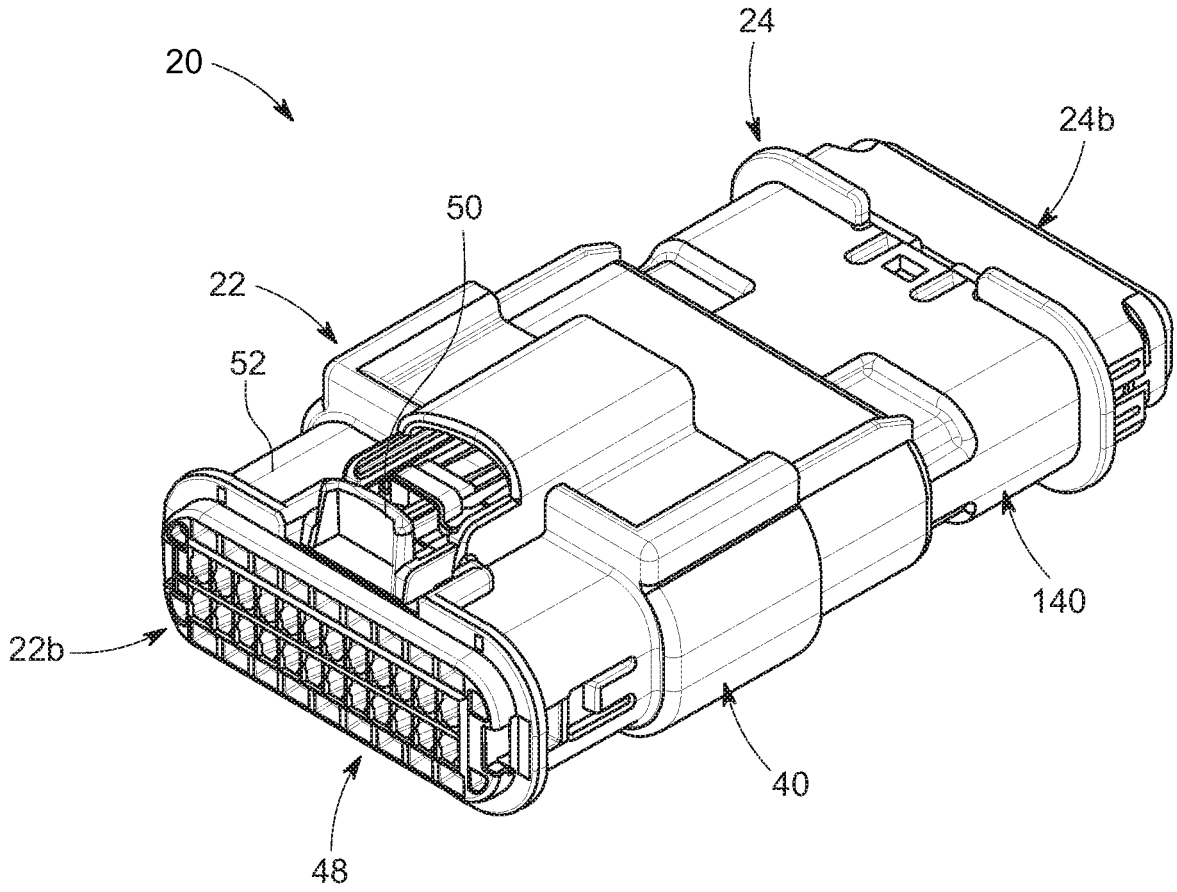
FIG. 1 is a perspective view of an electrical connector system having first and second connector assemblies, viewed from a rear end of one of the connector assemblies.
Figure 2:
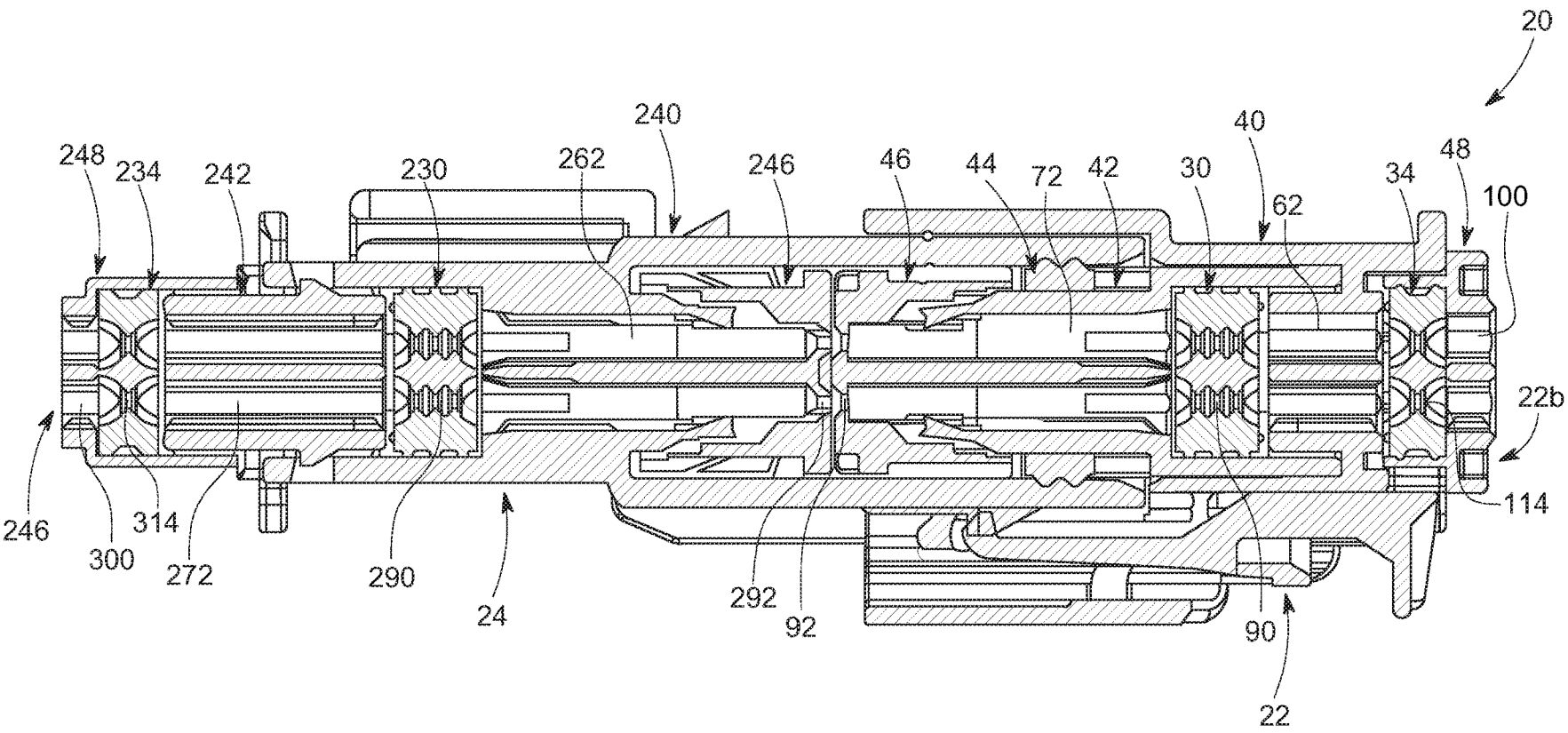
FIG. 2 is a cross-sectional view of the electrical connector system of FIG. 1.
Figure 3:
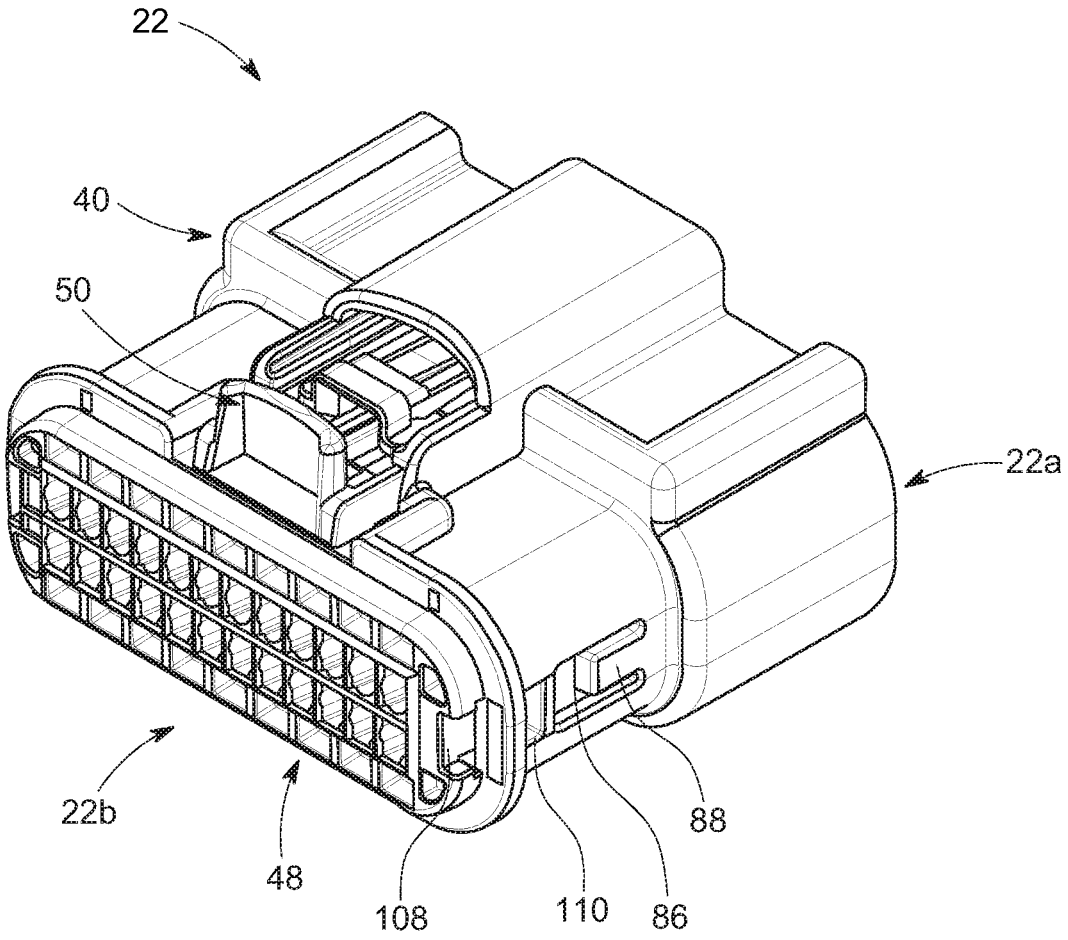
FIG. 3 is a rear perspective view of the first connector assembly of FIG. 1.
Figure 4:
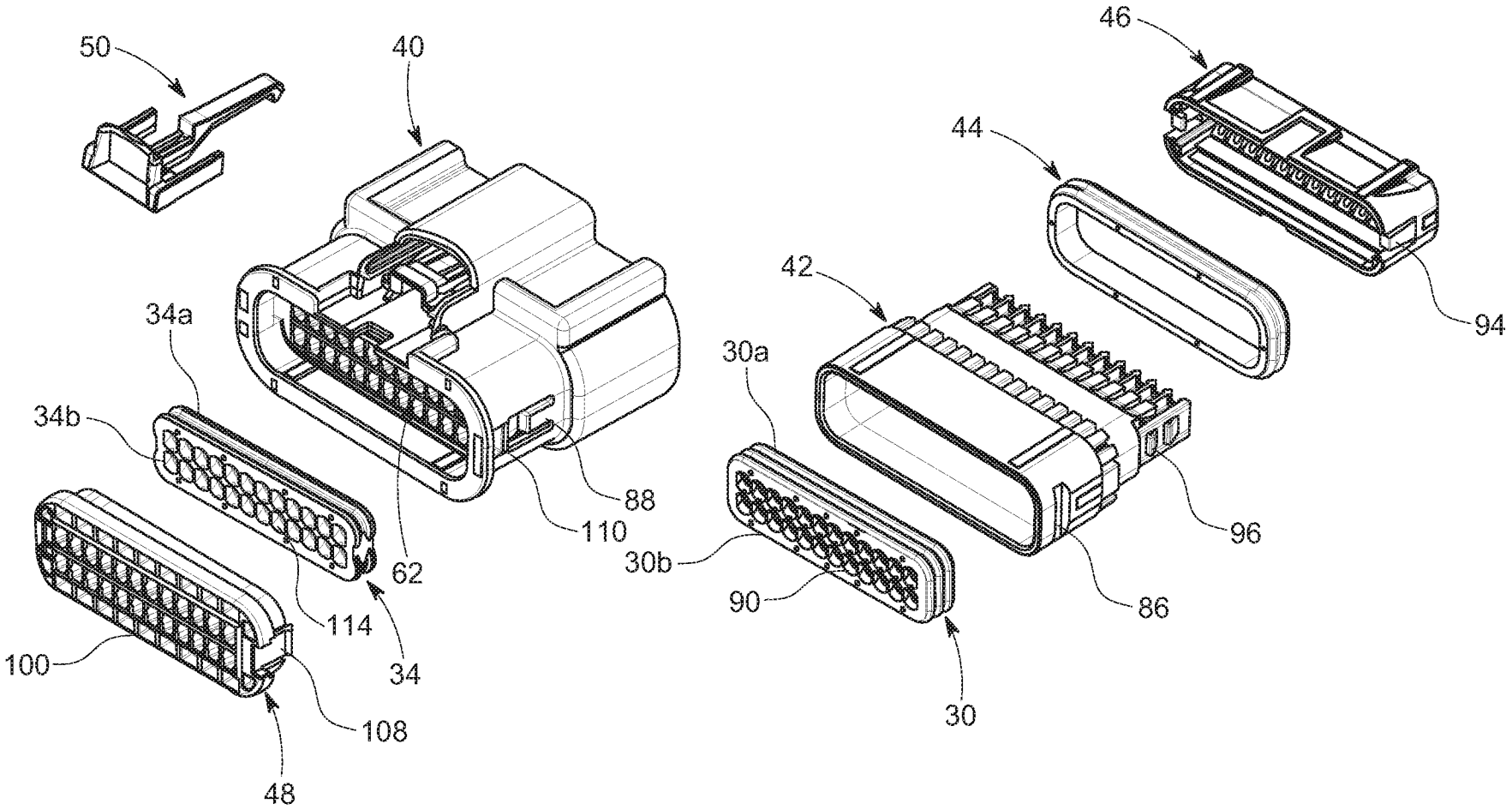
FIG. 4 is an exploded, rear perspective view of the first connector assembly of FIG. 3.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

A sealed electrical connector system 20, 320 is typically used in an automobile or other vehicle. The sealed electrical connector system 20, 320 of the present disclosure achieves sealing class 3 (per USCAR-2, GMW3191, ISO 20653 and similar specifications), which is commonly referred to as high pressure spray.

In a first configuration, the electrical connector system 20 includes first and second connector assemblies 22, 122, 24 which have front ends 22*a*, 122*a*, 24*a* which are releasably mated together. In an embodiment, the connector assemblies 22, 122, 24 are formed from a receptacle assembly and a blade assembly. A first embodiment of the first connector assembly 22 is shown in FIGS. 3-14. A second embodiment of the first connector assembly 122 is shown in FIGS. 15-23. The second connector assembly 24 is shown in FIGS. 24-34. The first connector assembly 22, 122 and the second connector assembly 24 include electrical terminals (not shown) generally attached to lead wires that electrically engage each other upon mating of the of the first connector assembly 22, 122 and the second connector assembly 24. Each of the first connector assembly 22, 122 and the second connector assembly 24 includes a conventional primary seal 30, 130, 230 which prevents the entry of moisture and debris from passing though the electrical connector system 20 and which achieves standard sealing (S2) performance. Each of the first connector assembly 22, 122 and the second connector assembly 24 further includes a secondary seal 34, 134, 234 at a rear end 22*b*, 122*b*, 24*b*, which form a wire exit portion, and which prevents high pressure spray from being directly applied to the primary seal 30, 130, 230. The secondary seal 34, 134, 234 minimizes the direct spray contacting the primary seal 30, 130, 230 by adding an additional sacrificial seal. The secondary seal 34, 134, 234 deflects the direct spray from contacting the primary seal 30, 130, 230.

In a second configuration, the electrical connector system 320 includes the first connector assembly 22, 122 and a second connector assembly 324 which have front ends 22*a*, 122*a*, 324*a* which are releasably mated together. The second connector assembly 324 is shown in FIGS. 35-39.

Directional terms such as front, rear, top, bottom and the like are used herein for convenience in describing the connector system and do not denote a required orientation. As used herein, "front" is used in the context of the mating direction of each of the first connector assembly 22, 122, the second connector assembly 24 and the connector housing 1040.

Attention is invited to the first embodiment of the first connector assembly 22 shown in FIGS. 3-14. The first connector assembly 22 includes an outer housing 40, a terminal housing 42, a mat seal 30, a ring seal 44, a primary lock reinforcement 46, a shield seal 34 and a shield seal cap 48. The mat seal 30 forms the primary seal in the first connector assembly 22 as is known in the art. The shield seal 34 provides the secondary seal. A connector position assurance device 50 may also be provided.

Figure 5:
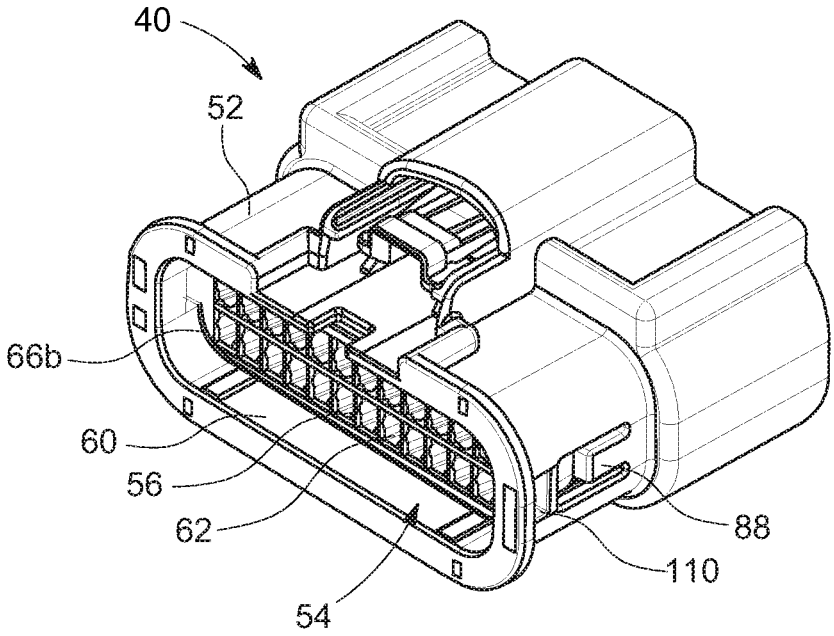
FIG. 5 is a rear perspective view of an outer housing of the first connector assembly of FIG. 3.
Figure 6:
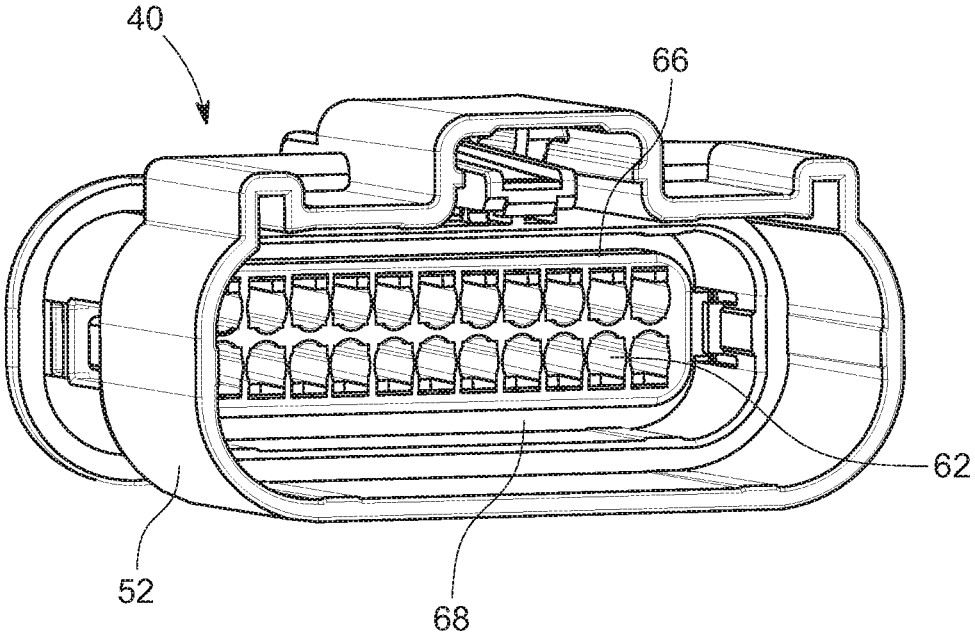
FIG. 6 is a front perspective view of the outer housing of FIG. 5.
Figure 7:
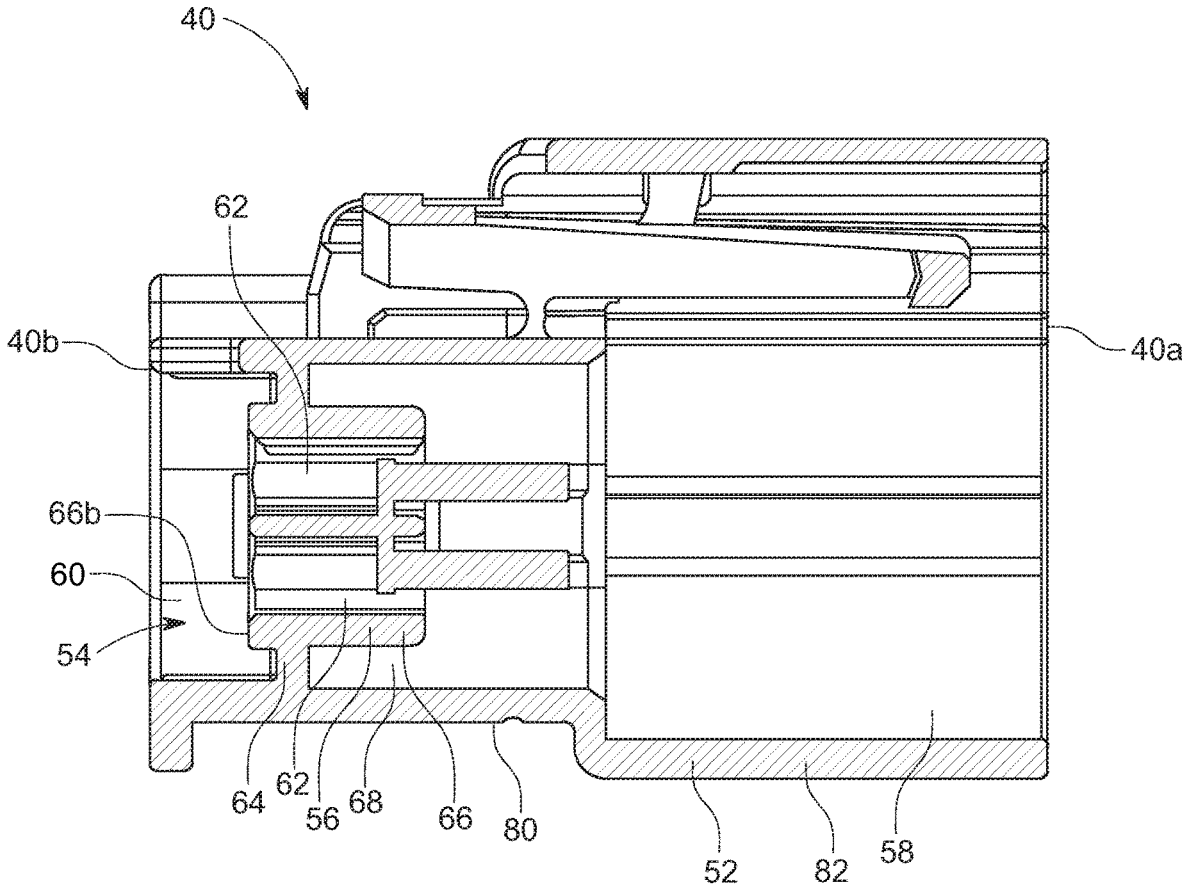
FIG. 7 is a cross-sectional view of the outer housing of FIG. 5.

The outer housing 40, see FIGS. 5-7, is formed of an insulative material and has an outer wall 52 having an internal cavity 54 therein extending from a front end 40*a* of the outer housing 40 to a rear end 40*b* of the outer housing 40. An internal dividing wall 56 is provided within the outer wall 52 and separates the cavity 54 into a front cavity portion 58, a rear cavity portion 60 and a plurality of terminal receiving passageways 62 in communication with the front and rear cavity portions 58, 60 and which extend through the internal dividing wall 56. The front cavity portion 58 extends from the front end 40*a* to the dividing wall 56 and defines an open end at the front end 40*a* of the outer housing 40. The rear cavity portion 60 extends from the rear end 40*b* to the dividing wall 56 and defines an open end at the rear end 40*b* of the outer housing 40. The dividing wall 56 has a first wall portion 64 extending radially inwardly from the outer wall 52 and a second wall portion 66 extending longitudinally along the outer wall 52 such that a pocket 68 is formed between the outer wall 52 and the second wall portion 66. The second wall portion 66 has a planar rear face 66*b*. The pocket 68 forms part of the front cavity portion 58. The terminal receiving passageways 62 extend in the longitudinal direction through the second wall portion 66.

Figure 8:
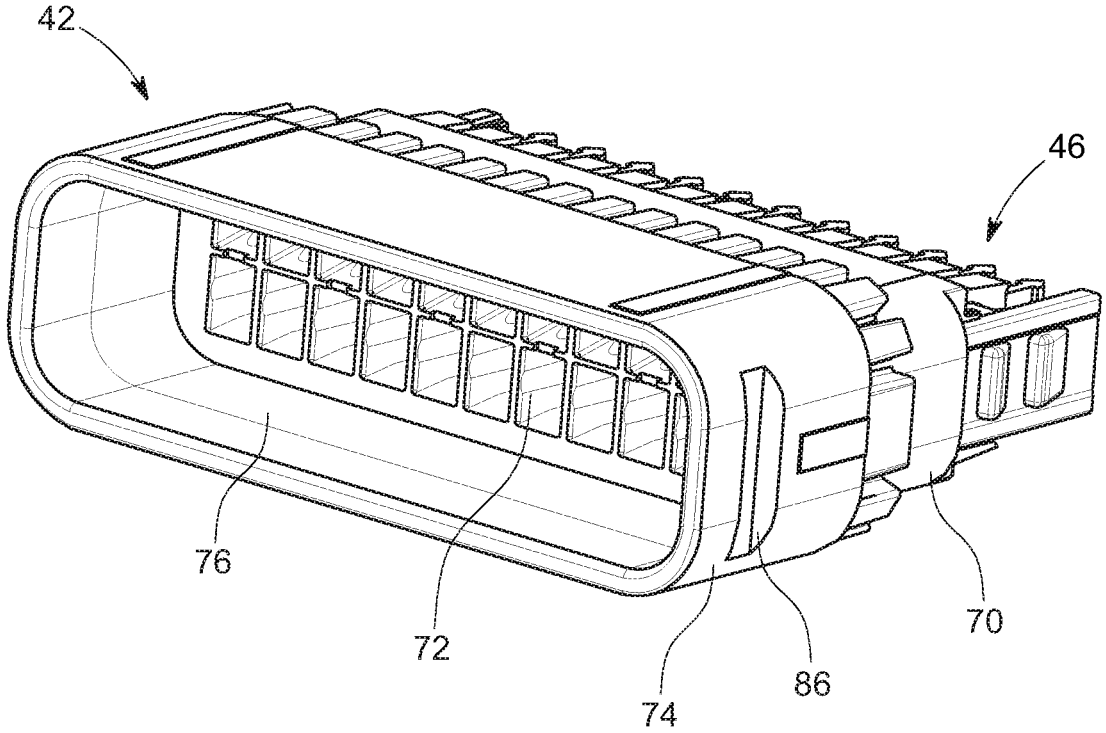
FIG. 8 is a rear perspective view of a terminal housing of the first connector assembly of FIG. 3.
Figure 9:
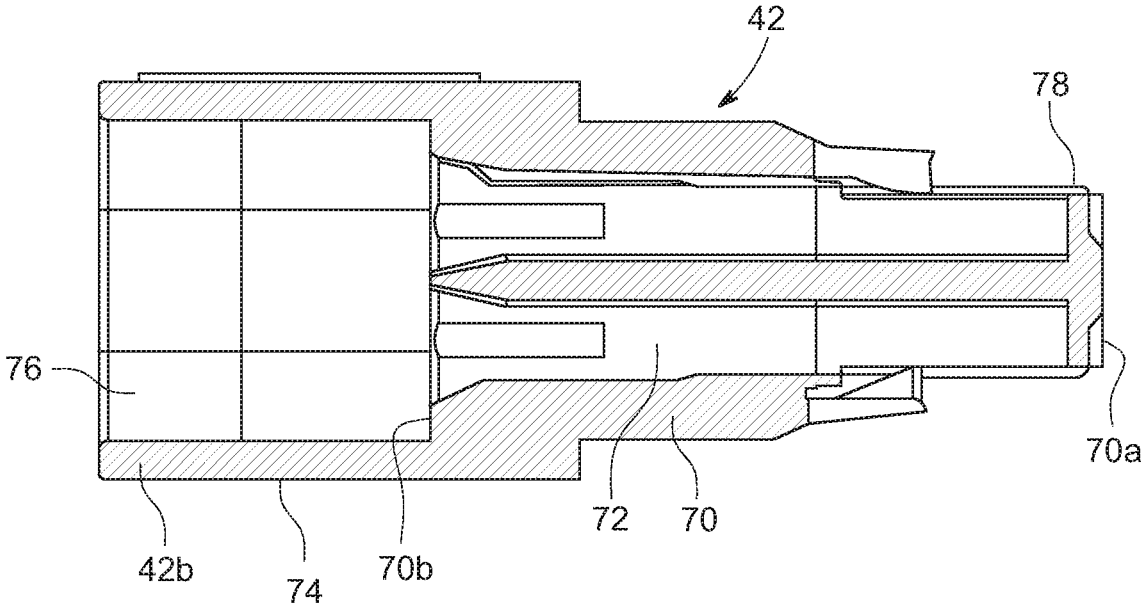
FIG. 9 is a cross-sectional view of the terminal housing of FIG. 8.

The terminal housing 42, see FIGS. 8 and 9, is formed of an insulative material and has a front wall 70 having a plurality of terminal receiving passageways 72 extending from a front face 70*a* to a rear face 70*b* thereof, and a rear wall 74 depending from outer edges of the front wall 70 such that a cavity 76 having an open end is formed. A rear end portion 42*b* of the terminal housing 42 engages in the pocket 68 of the outer housing 40 such that the second wall portion 66 of the dividing wall 56 seats within the cavity 76 and the rear wall 74 engages against a rear portion 80 of the outer wall 52. An end portion 78 of the front wall 70 extends forwardly from the front end 40*a* of the outer housing 40. The front wall 70 is spaced from a front portion 82 of the outer wall 52 such that a cavity 84 is formed between the front portion 82 and the outer wall 52. The terminal housing 42 has a locking feature 86, such as a pair of recesses in the rear wall 74, which engages with a locking feature 88, such as tabs provided on flexible finger portions of the outer wall 52 of the outer housing 40, to form a lock between the terminal housing 42 and the outer housing 40.

The mat seal 30 is elastomeric and is seated within the cavity 76 of the terminal housing 42 and abuts against a rear face of the front wall 70. The outer edge of the mat seal 30 engages, and seals, with the inner surface of the rear wall 74. The mat seal 30 is provided with a plurality of terminal receiving passageways 90 extending from a front face 30*a* to a rear 30*b* thereof. The front face 30*a* and the rear face 30*b* are planar. The terminal receiving passageways 90 align longitudinally with the terminal receiving passageways 62 through the outer housing 40 and with the terminal receiving passageways 72 through the terminal housing 42.

The ring seal 44 is formed from an elastomeric material and is of a frame-like configuration. The ring seal 44 is mounted over the front wall 70 of the terminal housing 42, extends partially into the cavity 84, and is spaced from the inner surface of the front portion 82 of the outer wall 52.

The primary lock reinforcement 46 is seated in the front cavity portion 58 of the outer housing 40, abuts against the ring seal 44, and engages with the front wall 70 of the terminal housing 42. The primary lock reinforcement 46 has a passageway 92 provided therethrough to allow the front wall 70 to pass therethrough. The primary lock reinforcement 46 has a locking feature 94, such as tabs provided on flexible finger portions, which engages with a locking feature 96, such as a pair of recesses in the front wall 70 of the terminal housing 42 to form a lock between the primary lock reinforcement 46 and the terminal housing 42, and thus the outer housing 40, and to further mate the ring seal 44 with the terminal housing 42.

Figure 10:
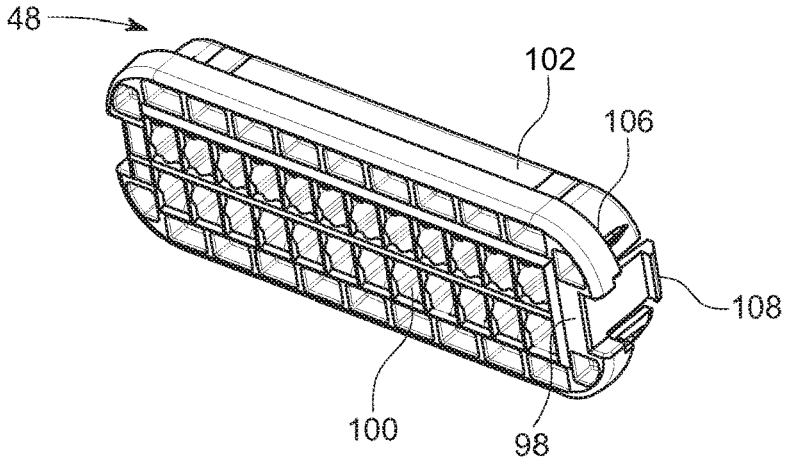
FIG. 10 is a rear perspective view of a shield seal cap of the first connector assembly of FIG. 1.
Figure 11:
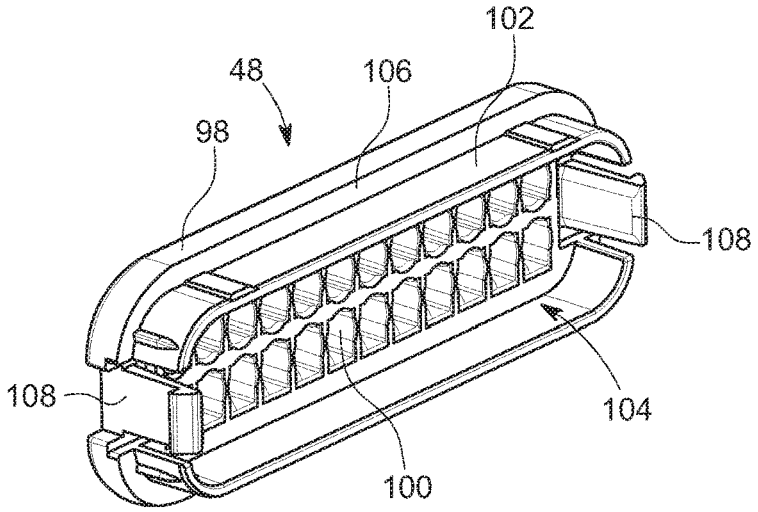
FIG. 11 is a front perspective view of the shield seal cap of FIG. 10.
Figure 12:
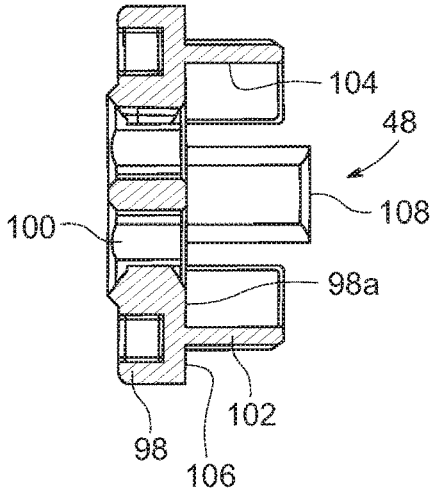
FIG. 12 is a cross-sectional view of the shield seal cap of FIG. 10.
Figure 13:
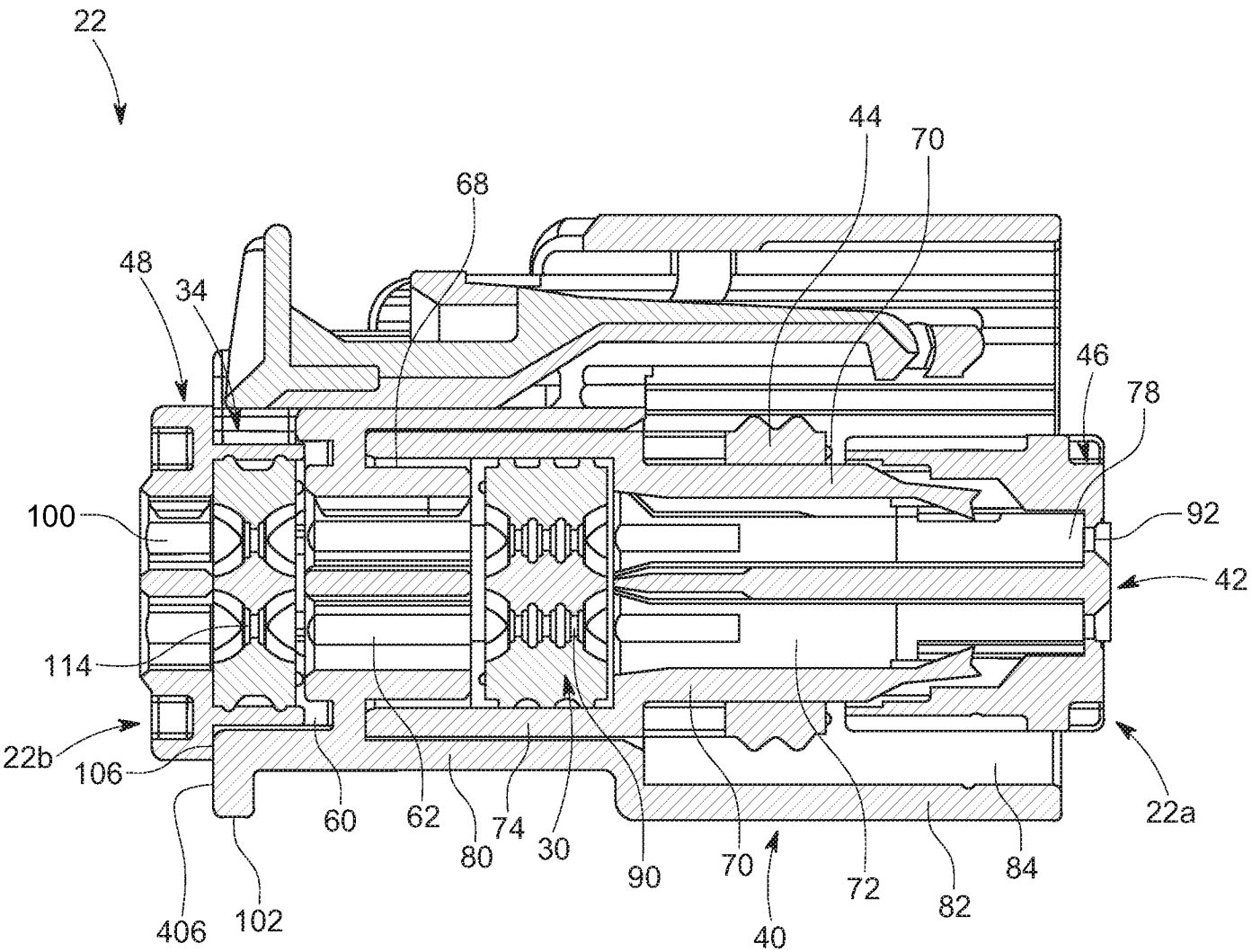
FIG. 13 is a cross-sectional view of the first connector assembly of FIG. 3.
Figure 14:
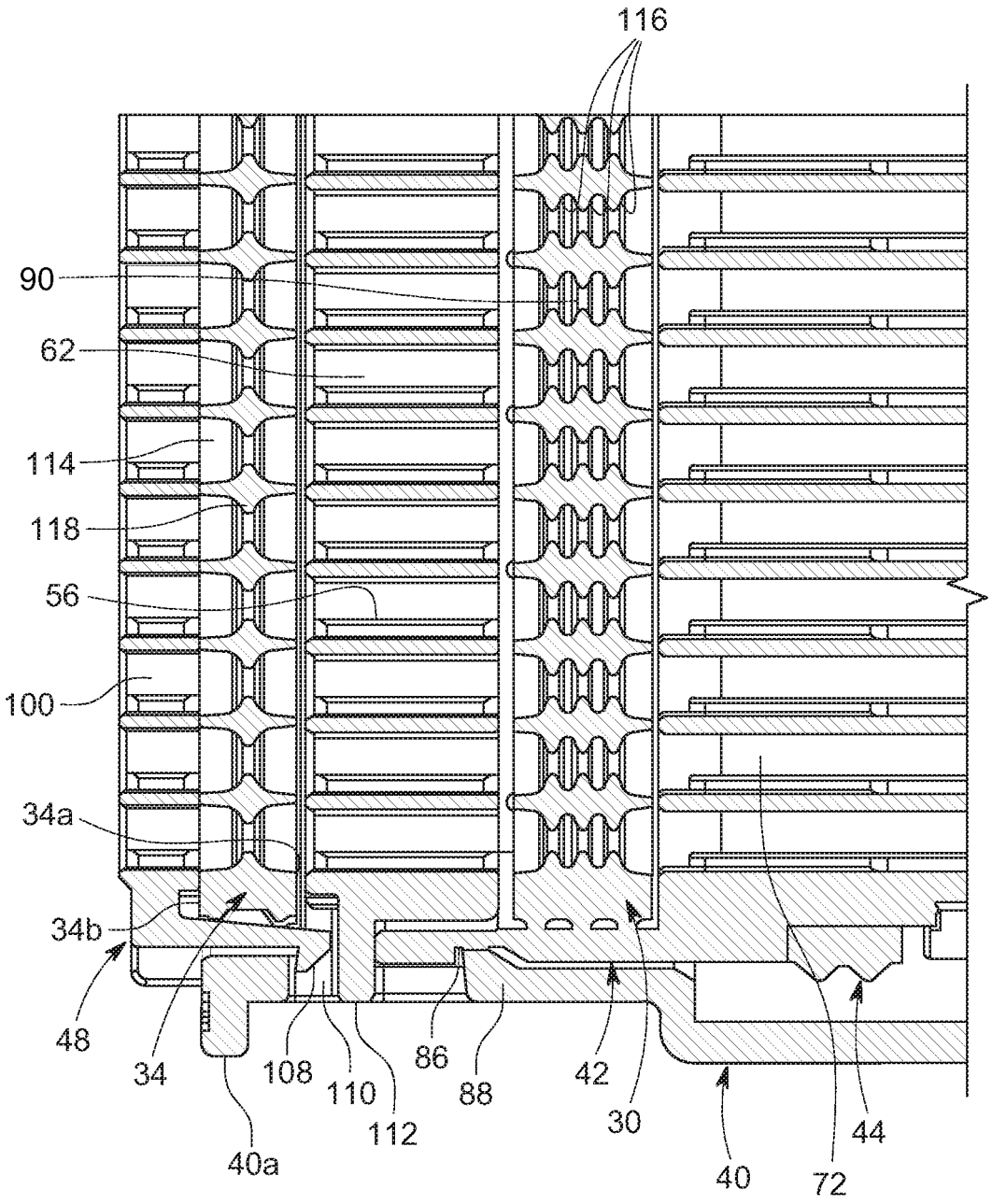
FIG. 14 is a partial cross-sectional view of the first connector assembly of FIG. 3.
Figure 15:
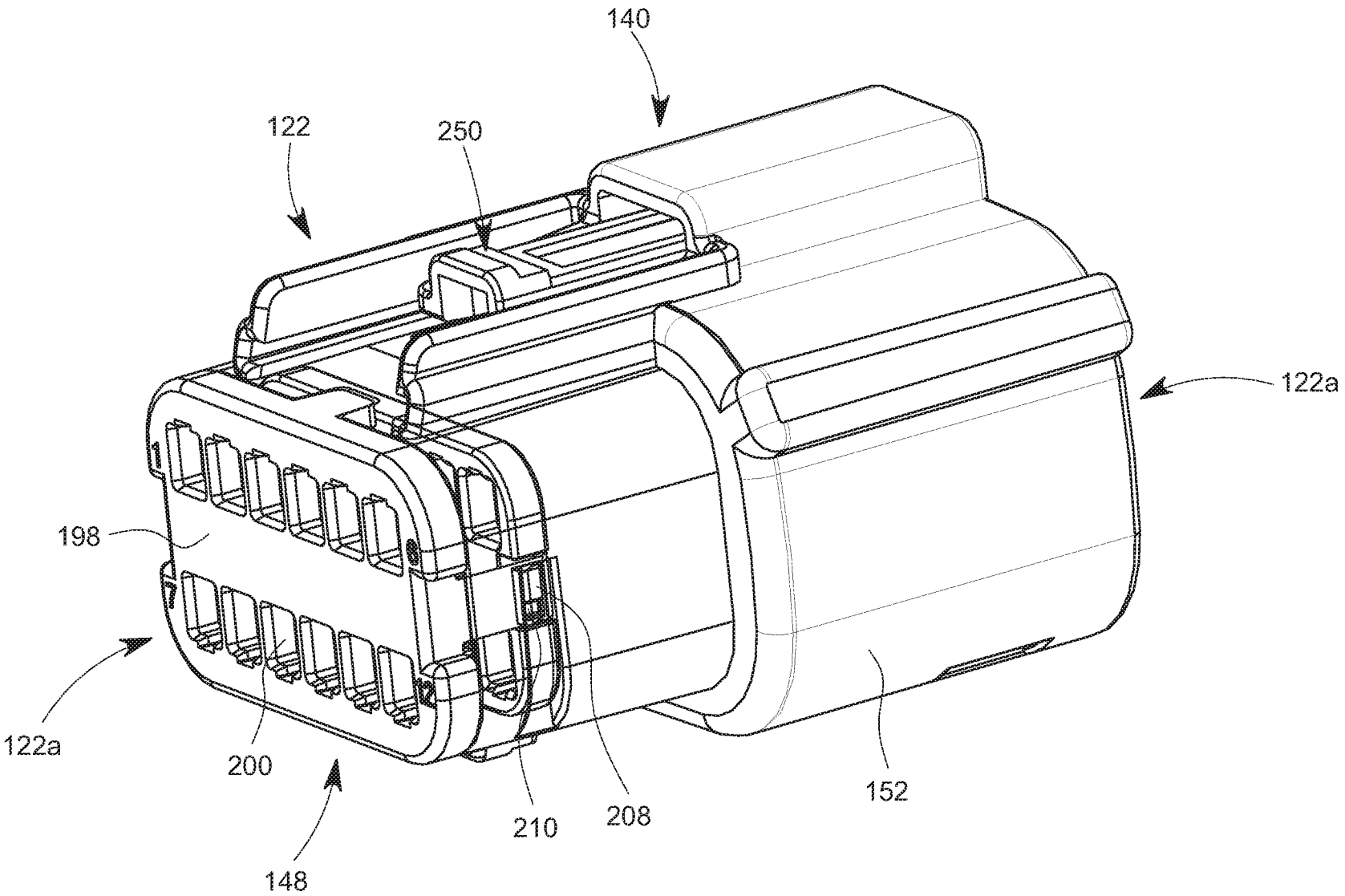
FIG. 15 is a rear perspective view of an alternate first connector assembly which can be used with the second connector assembly shown in FIG. 1.
Figure 16:
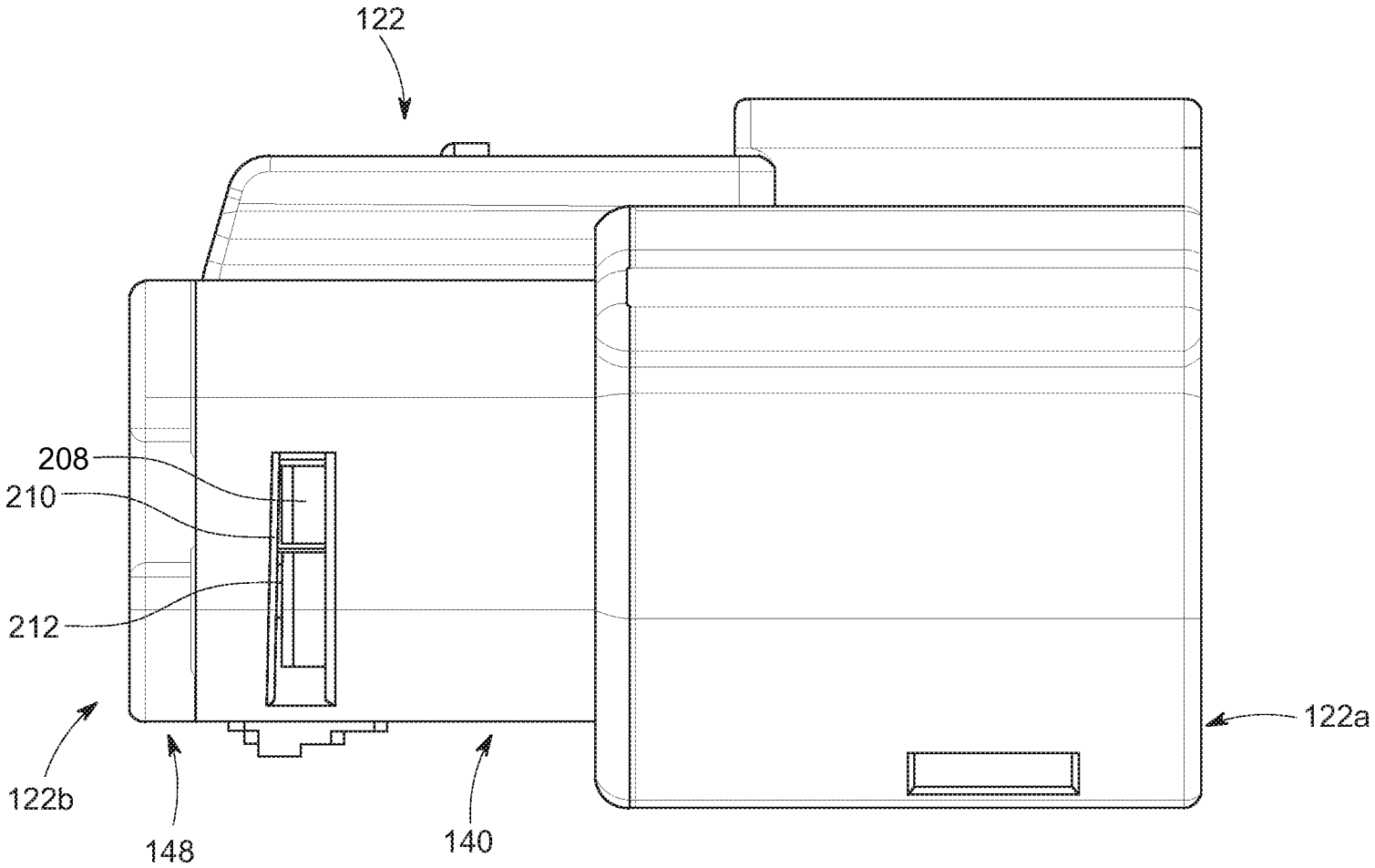
FIG. 16 is a side elevation view of the first connector assembly of FIG. 15.
Figure 17:
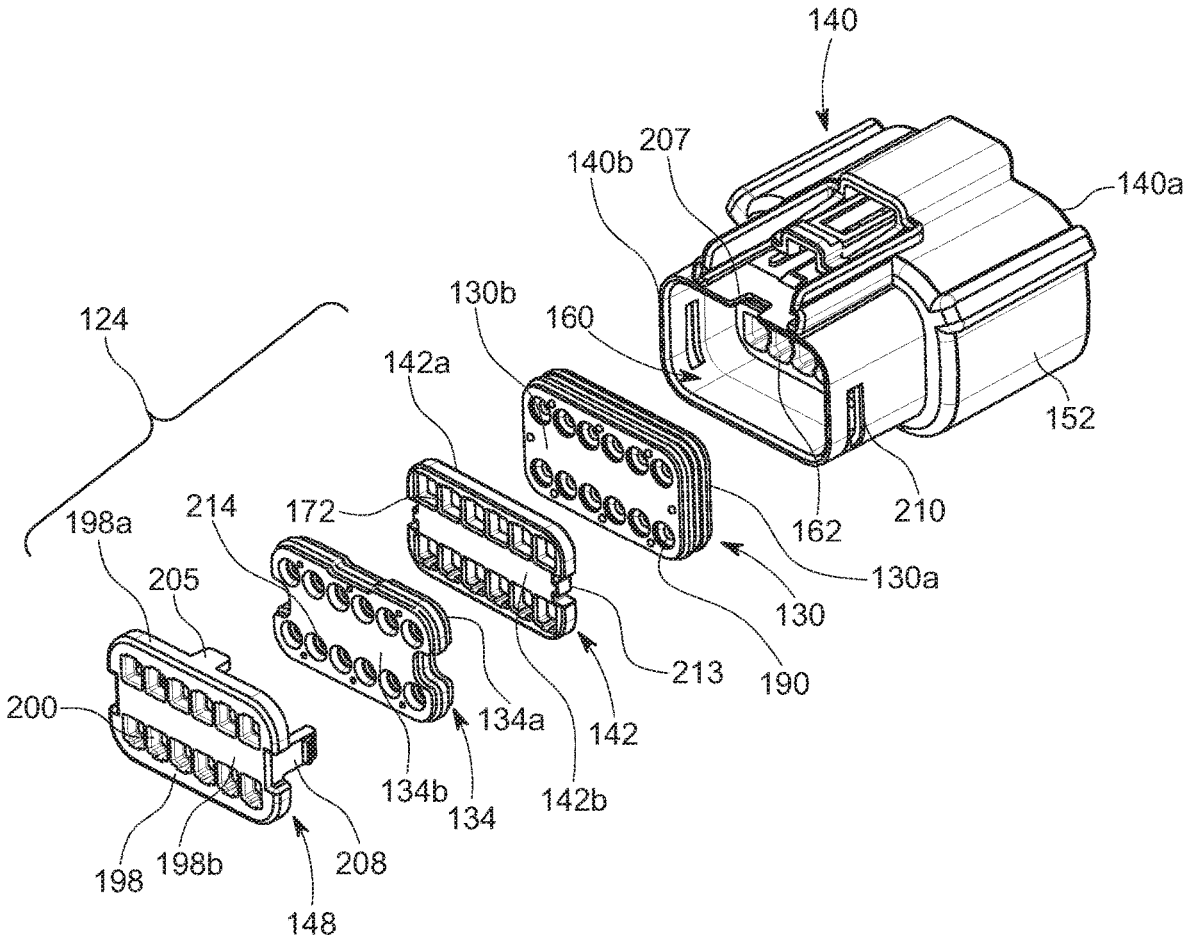
FIG. 17 is an exploded, rear perspective view of the first connector assembly of FIG. 15.
Figure 18:
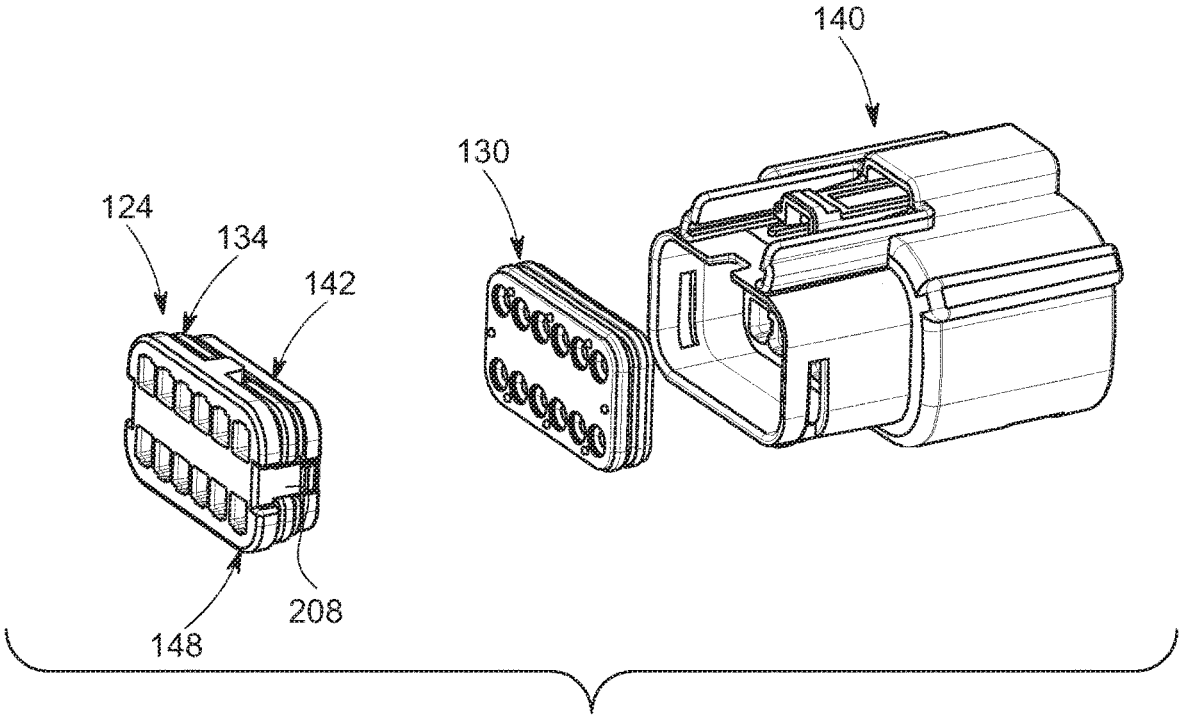
FIG. 18 is a partially exploded, rear perspective view of the first connector assembly of FIG. 15, showing a subassembly, a mat seal and an outer housing.
Figure 19:
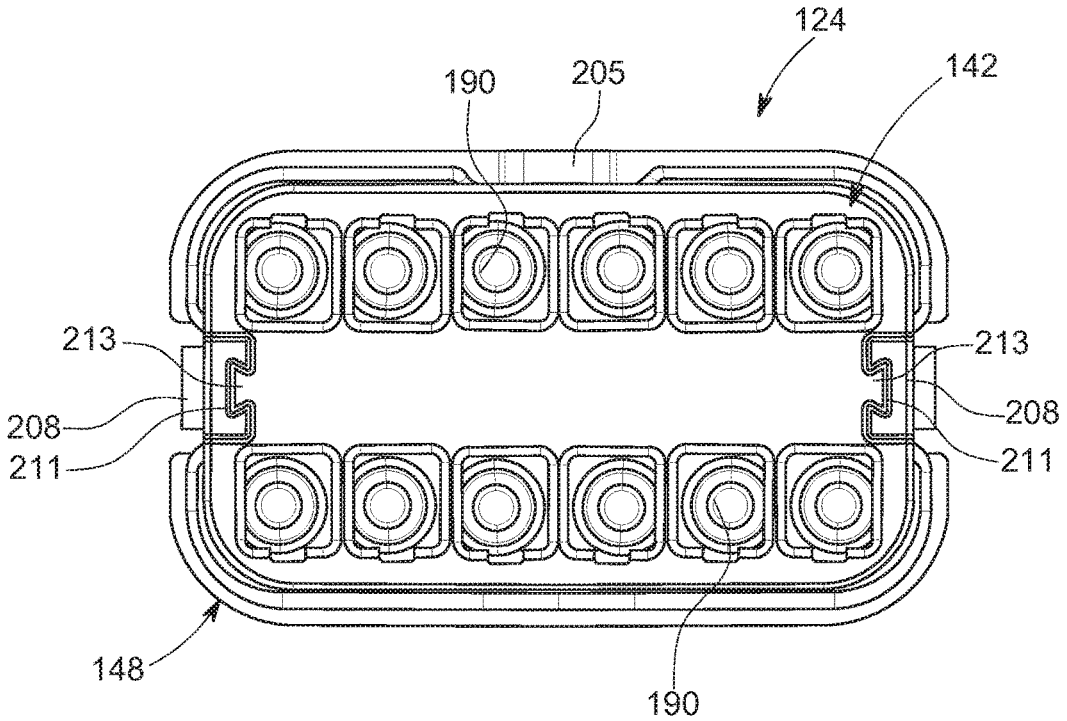
FIG. 19 is a front elevation view of the subassembly.

The shield seal cap 48, see FIGS. 10-12, is formed of an insulative material and has a rear wall 98 having a plurality of terminal receiving passageways 100 therethrough and a front wall 102 depending from the rear wall 98 such that a cavity 104 having an open front end is formed. The front wall 102 is spaced inwardly from the outer edges of the rear wall 98. As shown, the front wall 102 seats within the rear cavity portion 60 of the outer housing 40 and a front surface 106 of the rear wall 98 engages the rear end 40*b* of the outer housing 40. The shield seal cap 48 has a locking feature 108, such as tabs provided on flexible finger portions of the front wall 102, which engages with a locking feature 110, such as openings, through the rear portion 80 of the outer wall 52 to form a lock between the shield seal cap 48 and the outer housing 40. The openings 110 through the outer housing 40 are larger than the tabs 108 on the shield seal cap 48 such that a gap 112, see FIG. 14, is provided between the tabs 108 and the rear portion 80 to provide for a leak path as described herein. In addition, a leak path may be provided between the tabs 108 and the rear end of the outer wall 52.

The shield seal 34 is elastomeric and has a plurality of terminal receiving passageways 114 which extend from a front face 34*a* to a rear face 34*b* thereof. The front face 34*a* and the rear face 34*b* are planar. The shield seal 34 is seated within the cavity 104 of the shield seal cap 48 and the outer edge of the shield seal 34 engages, and seals, with the inner surface of the front wall 102. The shield seal cap 48 secures the shield seal 34 to the outer housing 40. The front face 34*a* of the shield seal 34 is generally aligned with or rearward of the opening 110, and is proximate to, but spaced from, a rear face of the dividing wall 56 of the outer housing 40. The rear face 34*b* of the shield seal 34 abuts against a front face 98*a* of the rear wall 98. The terminal receiving passageways 114 align longitudinally with the terminal receiving passageways 62 through the outer housing 40 and the terminal receiving passageways 100 through the shield seal cap 48.

The terminal receiving passageways 100, 114, 62, 90, 72 align longitudinally with each other and wire terminated electrical terminals (not shown) extend through predetermined ones of the aligned terminal receiving passageways 100, 114, 62, 90, 72 (unused ones are plugged by plugs (not shown) extending from the dividing wall 56). The terminal housing 42 guides the terminals into the terminal receiving passageways 90 of the mat seal 30. Each terminal receiving passageway 90 in the mat seal 30 and each terminal receiving passageway 114 in the shield seal 34 includes at least one lobe which is compressed against the terminal when the terminal extends therethrough. As shown, the mat seal 30, which is the primary seal, has three lobes 116, but only two lobes may be provided, or more than three lobes may be provided. The shield seal 34, which is the secondary seal, has a single lobe 118, but more than one lobe 118 may be provided. Each lobe 116, 118 is compressed against the terminal when the terminal extends therethrough to provide a seal against the terminal.

A leak path is thus provided between the front face 34*a* of the shield seal 34 and the dividing wall 56 of the outer housing 40 and through the mating locking features 108, 110 of the shield seal cap 48 and the outer housing 40.

When a high-pressure spray (pressure of 90 bar spraying the first connector assembly 22 at approximately a distance of 100 mm) of liquid is directed at the rear end 40*b* of the outer housing 40 which forms a rear end of the first connector assembly 22, the liquid passes into the terminal receiving passageways 114 of the shield seal cap 48 and between the terminal and the lobe 118 of the shield seal 34 since the liquid is under high pressure. As the liquid passes therethrough, the pressure of the liquid spray decreases such that any liquid that subsequently passes through the terminal receiving passageways 62 of the dividing wall 56 and engages the lobes 116 of the mat seal 30 is reduced sufficiently such that the liquid does not pass between the terminals and the lobes 116 of the mat seal 30. Also, the liquid drains out of the first connector assembly 22 through the leak path.

Attention is invited to the second embodiment of the first connector assembly 122 shown in FIGS. 15-23. The first connector assembly 122 includes an outer housing 140, a ring seal (not shown), a primary lock reinforcement (not shown), a mat seal 130, and a subassembly 124 which is plugged into a rear end 140*b* of the outer housing 140 and which engages the mat seal 130. The subassembly 124 includes a terminal housing 142, a shield seal cap 148 which is attached to the terminal housing 142 and has a shield seal 134 provided between the terminal housing 142 and the shield seal cap 148. The mat seal 130 forms the primary seal in the first connector assembly 122 as is known in the art. The shield seal 134 provides the secondary seal. A connector position assurance device 150 may also be provided.

Figure 20:
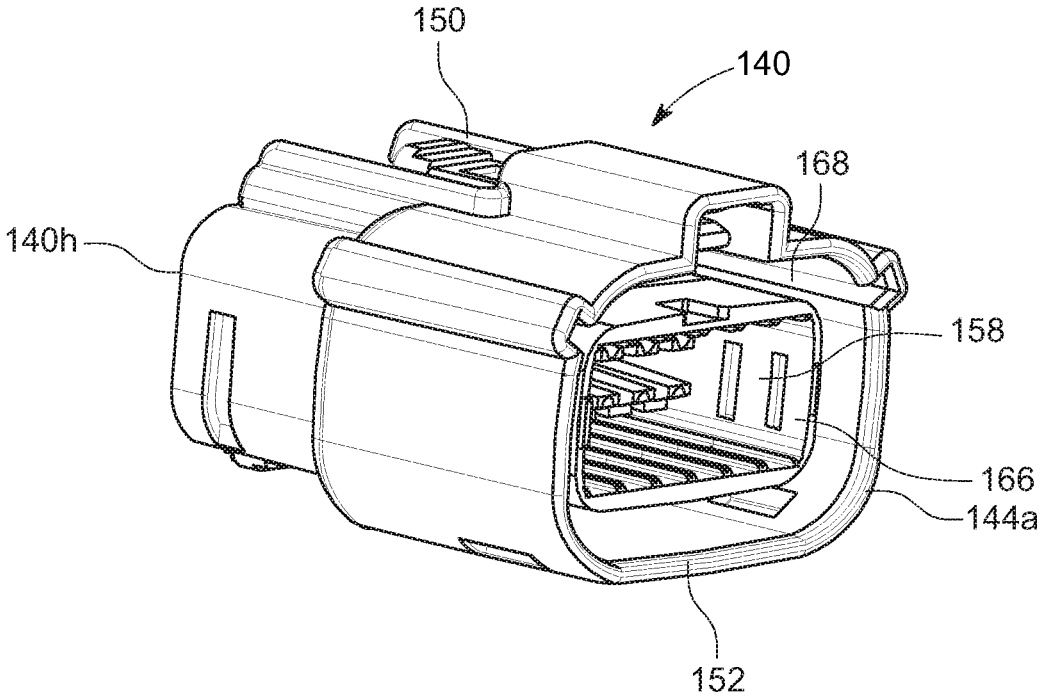
FIG. 20 is a front perspective view of an outer housing of the first connector assembly of FIG. 15, with a connector position assurance device attached thereto.
Figure 21:
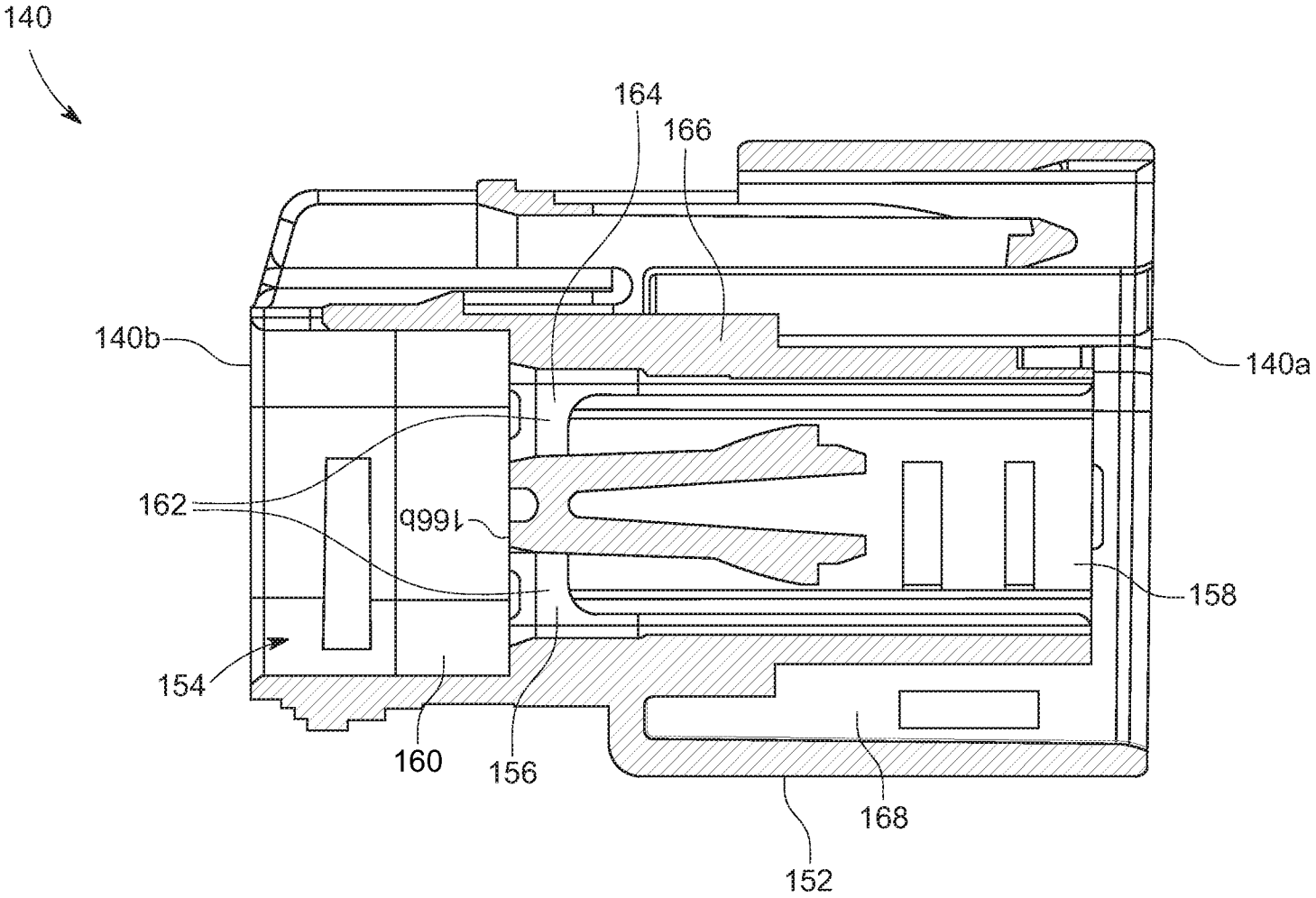
FIG. 21 is a cross-sectional view of the outer housing of FIG. 20.
Figure 22:
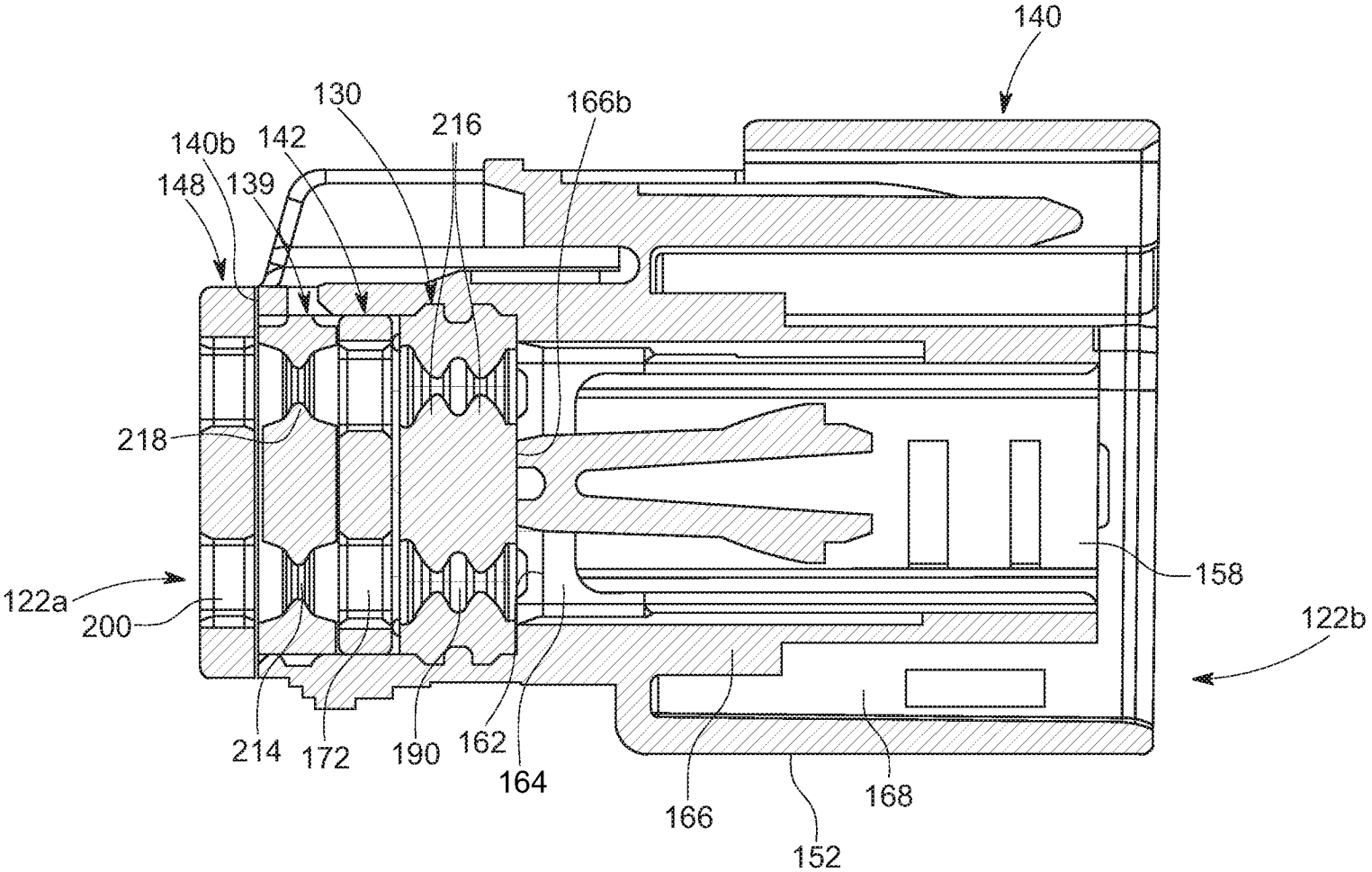
FIG. 22 is a cross-sectional view of the first connector assembly of FIG. 15.

The outer housing 140, see FIGS. 20 and 21, is formed of an insulative material and has an outer wall 152 having an internal cavity 154 extending from a front end 140*a* of the outer housing 140 to a rear end 140*b* of the outer housing 140. An internal dividing wall 156 is provided within the outer wall 152 and separates the cavity 154 into a front cavity portion 158, a rear cavity portion 160 and a plurality of terminal receiving passageways 162 in communication with the front and rear cavity portions 158, 160 and which extend through the internal dividing wall 156. The front cavity portion 158 extends from the front end 140*a* to the dividing wall 156 and defines an open end at the front end 140*a* of the outer housing 140. The rear cavity portion 160 extends from the rear end 140*b* to the dividing wall 156 and defines an open end at the rear end 140*b* of the outer housing 140. The dividing wall 156 has a first wall portion 164 extending radially inwardly from the outer wall 152 and a second wall portion 166 extending longitudinally along the outer wall 152 such that a pocket 168 is formed between the outer wall 152 and the second wall portion 166. The second wall portion 166 has a planar rear face 166*b*. The pocket 168 may form part of the front cavity portion 158. The terminal receiving passageways 162 extend in the longitudinal direction through the second wall portion 166.

The mat seal 130 is elastomeric and has a plurality of terminal receiving passageways 190 which extend from a front face 130*a* to a rear face 130*b* thereof. The front face 130*a* and the rear face 130*b* are planar. The mat seal 130 seats within the rear cavity portion 160 and the front face 130*a* of the mat seal 130 seats against the planar rear face 166*b* of the second wall portion 166. The outer edge of the mat seal 130 engages, and seals, with the inner surface of the outer wall 152. The terminal receiving passageways 190 align longitudinally with the terminal receiving passageways 162 through the outer housing 140.

The terminal housing 142 of the subassembly 124 is formed of an insulative material and has a plurality of terminal receiving passageways 172 which extend from a front face 142*a* to a rear face 142*b* thereof. The front face 142*a* and the rear face 142*b* are planar.

The shield seal 134 of the subassembly 124 is elastomeric and has a plurality of terminal receiving passageways 214 which extend from a front face 134*a* to a rear face 134*b* thereof. The front face 134*a* and the rear face 134*b* are planar.

The shield seal cap 148 of the subassembly 124 is formed of an insulative material and has a wall 198 having a plurality of terminal receiving passageways 200 which extend from a front face 198*a* to a rear face 198*b* thereof. The front face 198*a* and the rear face 198*b* are planar. The shield seal cap 148 has a mating feature 205, such as a tab extending forwardly from the front face 198*a*, which engages with a mating feature 207 on the outer housing 140, such as a recess in an outer perimeter of the outer wall 152, to form an engagement between the shield seal cap 148 and the outer housing 140 as described herein. The shield seal cap 148 has a locking feature 208, such as tabs provided on flexible finger portions which extend forwardly from the wall 198, which engages with a locking feature 210, such as openings, through the outer wall 152 to form a lock between the subassembly 124 and the outer housing 140 as described herein. The locking feature 208 further has a mating feature 211, such as a recess on each finger, which engages with a mating feature 213 on the terminal housing 142, such as a protrusion extending from an outer perimeter of the terminal housing 142, to form an engagement between the shield seal cap 148 and the terminal housing 142 as described herein.

In an embodiment, to form the subassembly 124, the rear face 134*b* of the shield seal 134 is abutted against the front face 198*a* of the shield seal cap 148 such that the shield seal 134 is between the locking features 208. The terminal receiving passageways 214 through the shield seal 134 align longitudinally with the terminal receiving passageways 200 through the shield seal cap 148. Thereafter, the rear face 142*b* of the terminal housing 142 is moved to be proximate to the front face 134*a* of the shield seal 134 and to engage the mating features 211, 213 to form the engagement and to affix the shield seal 134 between the shield seal cap 148 and the terminal housing 142. The terminal receiving passageways 172 through the terminal housing 142 align longitudinally with the aligned terminal receiving passageways 214, 200 through the shield seal 134 and the shield seal cap 148.

Thereafter, the subassembly 124 is inserted into the rear cavity portion 160 of the outer housing 140. When the subassembly 124 is inserted, the front face 142*a* of the terminal housing 142 seats against the planar rear face 130*b* of the mat seal 130, the terminal housing 142 and the shield seal 134 seat within the rear cavity portion 160, and the wall 198 of the shield seal cap 148 seats against the rear end 140*b* of the outer housing 140. The outer edge of the shield seal 134 engages, and seals, with the inner surface of the outer wall 152. The aligned terminal receiving passageways 172, 214, 200 through the subassembly 124 align longitudinally with the aligned terminal receiving passageways 190, 162 through the mat seal 130 and the outer housing 140. The locking features 208, 210 engage with each other when the subassembly 124 is inserted into the rear cavity portion 160 of the outer housing 140 to form the lock between the subassembly 124 and the outer housing 140. The mating features 205, 207 engage with each other when the subassembly 124 is inserted into the rear cavity portion 160 of the outer housing 140 to form the engagement between the subassembly 124 and the outer housing 140.

Figure 23:
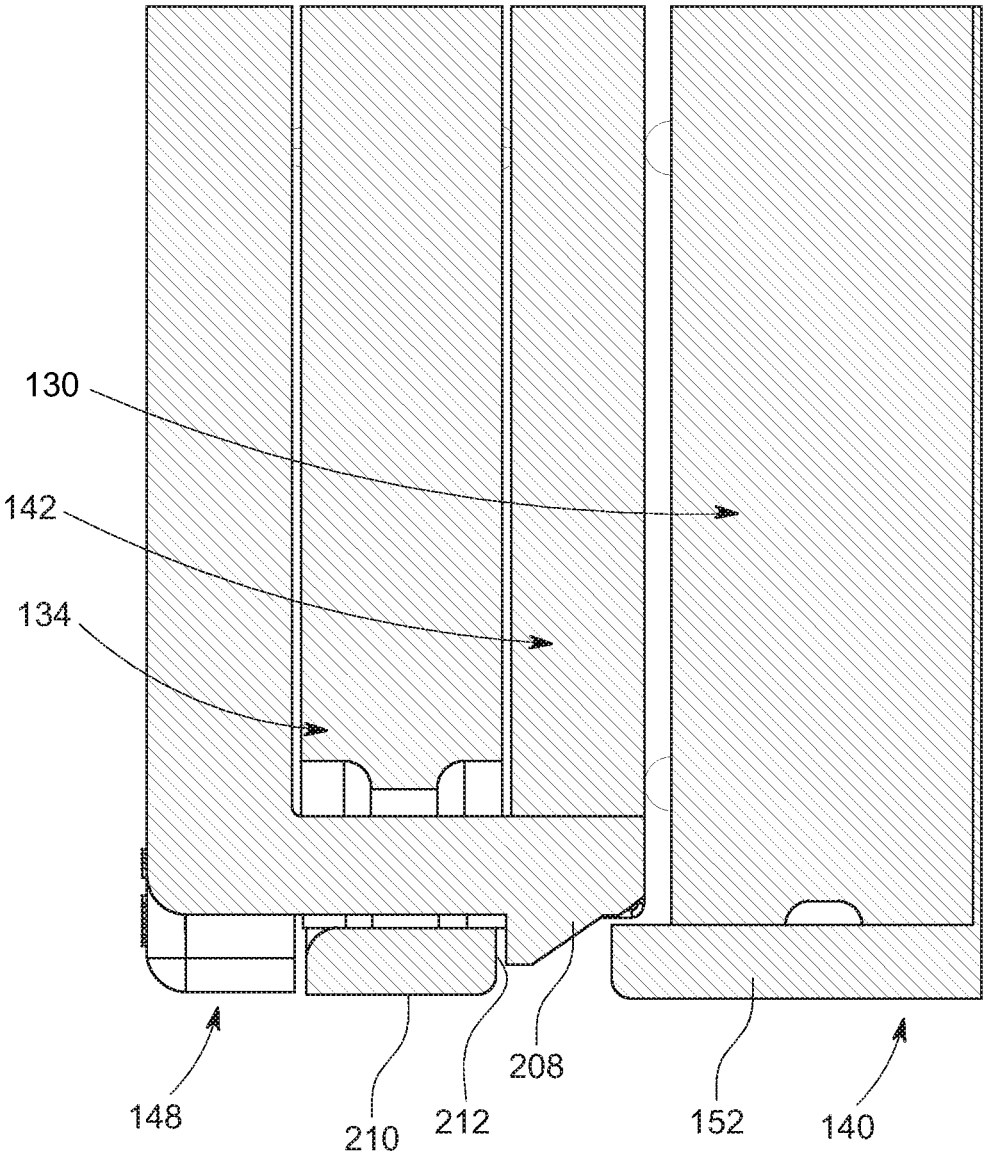
FIG. 23 is a partial cross-sectional view of the first connector assembly of FIG. 15.
Figure 24:
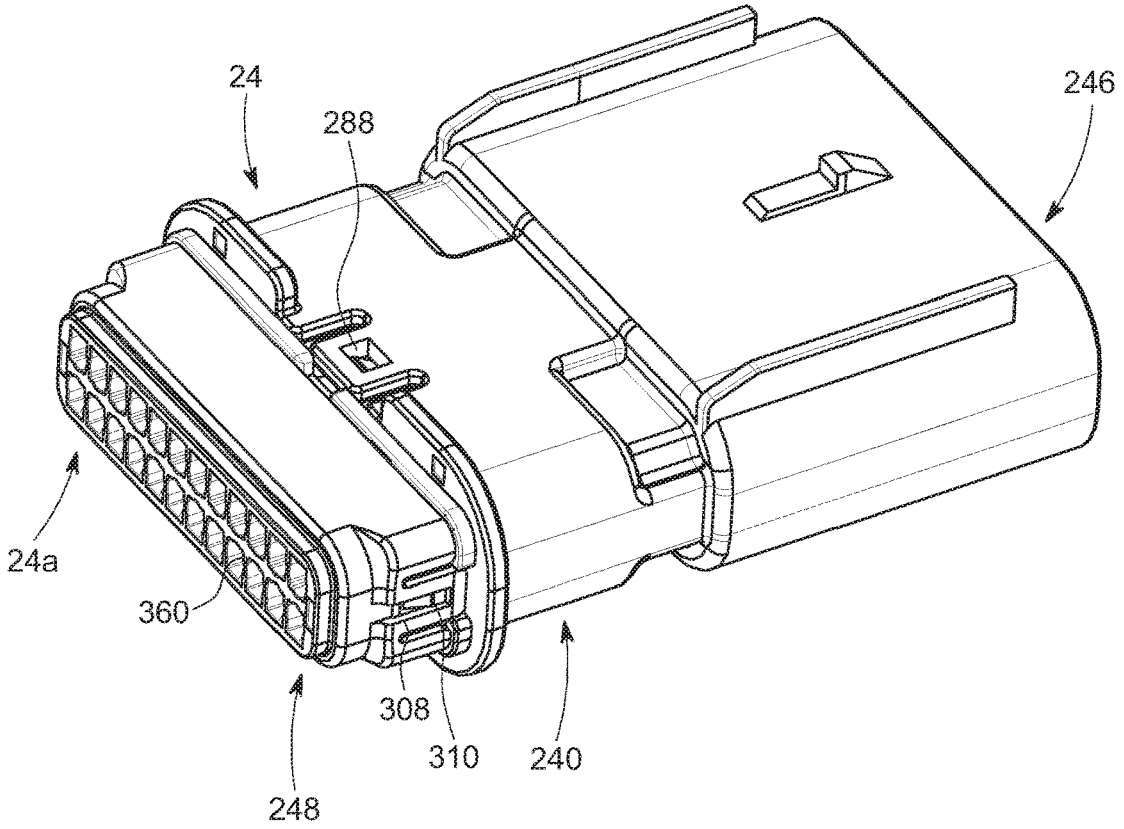
FIG. 24 is a front perspective view of the second connector assembly of FIG. 1.
Figure 25:
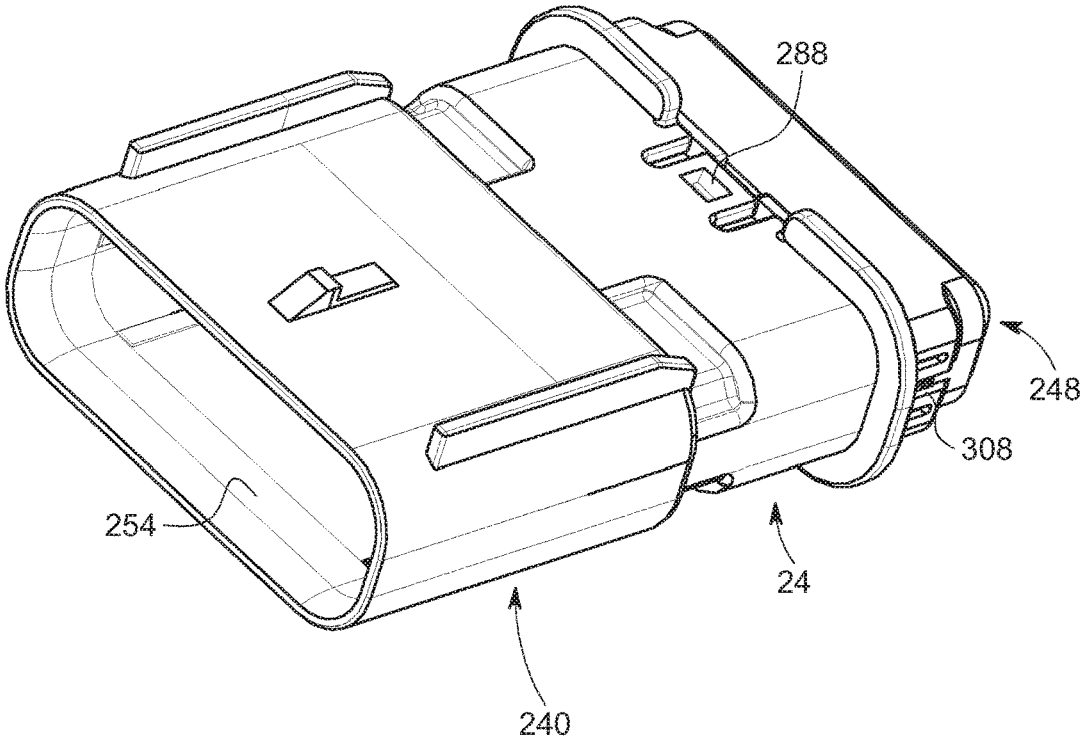
FIG. 25 is a rear perspective view of the second connector assembly of FIG. 24.
Figure 26:
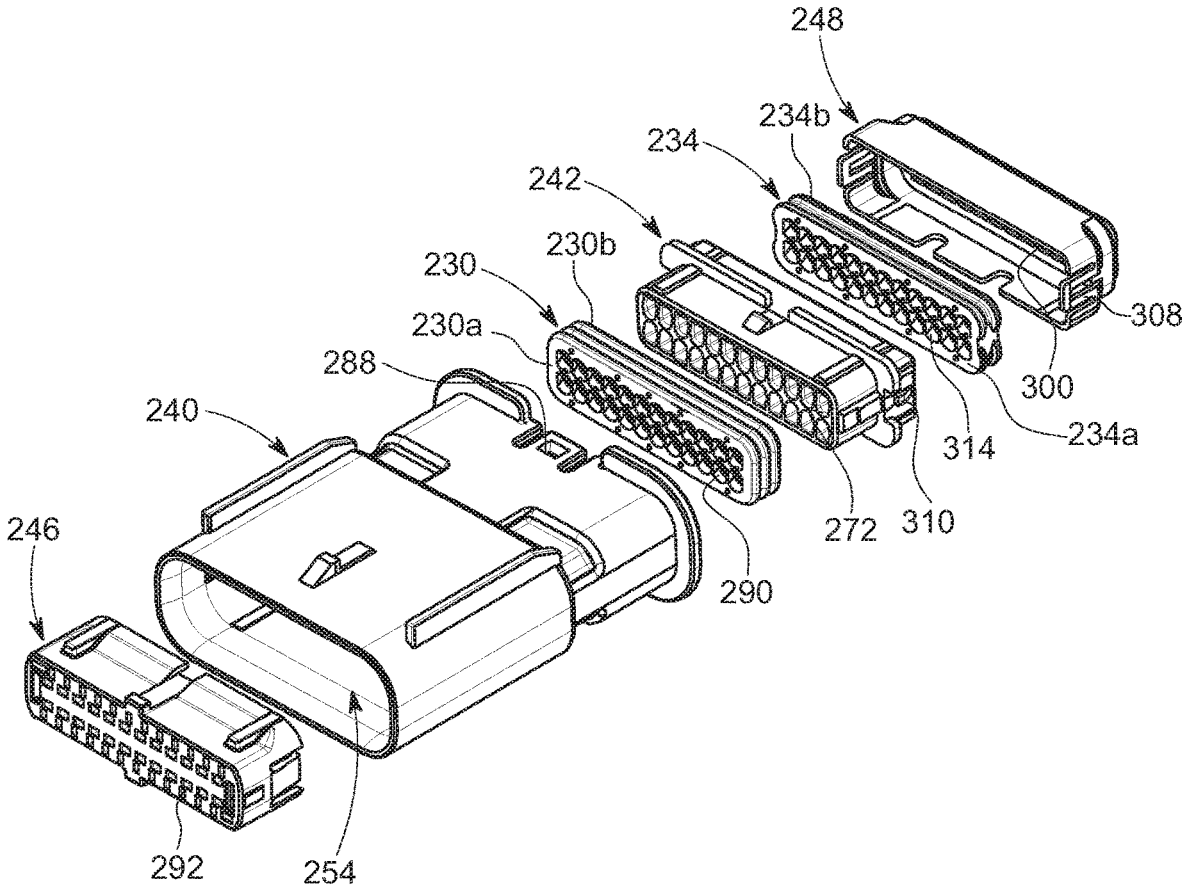
FIG. 26 is an exploded, front perspective view of the first connector assembly of FIG. 24.

The openings 210 through the outer housing 140 are larger than the tabs 208 on the shield seal cap 148 such that a gap 212, see FIG. 23, is provided between the tabs 208 and the outer wall 152 to provide for a leak path as described herein. In addition, a leak path may be provided between the tabs 208 and the rear end of the outer wall 152.

Wire terminated electrical terminals (not shown) extend through predetermined ones of the aligned terminal receiving passageways 200, 214, 172, 190, 162 (unused ones are plugged by plugs (not shown) extending from the dividing wall 156). The terminal housing 142 guides the terminals into the terminal receiving passageways 190 of the mat seal 130. Each terminal receiving passageway 190 in the mat seal 130 and each terminal receiving passageway 214 in the shield seal 134 includes at least one lobe which is compressed against the terminal when the terminal extends therethrough. As shown, the mat seal 130, which is the primary seal, has two lobes 216, but three or more lobes may be provided. The shield seal 134, which is the secondary seal, has a single lobe 218, but more than one lobe 218 may be provided. Each lobe 216, 218 is compressed against the terminal when the terminal extends therethrough to provide a seal against the terminal.

A leak path is thus provided between the front face 134*a* of the shield seal 134 and the rear face 142*b* of the terminal housing 142 and through the mating locking features 208, 210 of the shield seal cap 148 and the outer housing 140.

When a high-pressure spray (pressure of 90 bar spraying the first connector assembly 122 at approximately a distance of 100 mm) of liquid is directed at the rear end 140*b* of the outer housing 140, the liquid passes into the terminal receiving passageways 214 of the shield seal cap 148 and between the terminal and the lobe 218 of the shield seal 134 since the liquid is under high pressure. As the liquid passes therethrough, the pressure of the liquid spray decreases such that any liquid that subsequently passes through the terminal receiving passageways 62 of the dividing wall 156 and engages the lobes 216 of the mat seal 130 is reduced sufficiently such that the liquid does not pass between the terminals and the lobes 216 of the mat seal 130. Also, the liquid drains out of the first connector assembly 122 through the leak path.

The ring seal seats around the second wall portion 166 of the dividing wall 156 and extends into the pocket 168. The primary lock reinforcement is seated in the front cavity portion 158 of the outer housing 40 and the outer pocket 168 and abuts against the ring seal. The primary lock reinforcement has a passageway provided therethrough to allow the terminals to pass therethrough. The primary lock reinforcement has a locking feature, such as tabs provided on flexible finger portions, which engages with a locking feature, such as a pair of recesses in the outer wall 152 of the outer housing 140 to lock the primary lock reinforcement with the outer housing 140 and to further mate the ring seal with outer housing 140.

Attention is invited to the second connector assembly 24 shown in FIGS. 24-34. The second connector assembly 24 includes an outer housing 240, a mat seal 230, a terminal housing 242, a shield seal 234, a shield seal cap 248 and a primary lock reinforcement 246. The mat seal 230 forms the primary seal in the second connector assembly 24 as is known in the art. The shield seal 234 provides the secondary seal.

Figure 27:
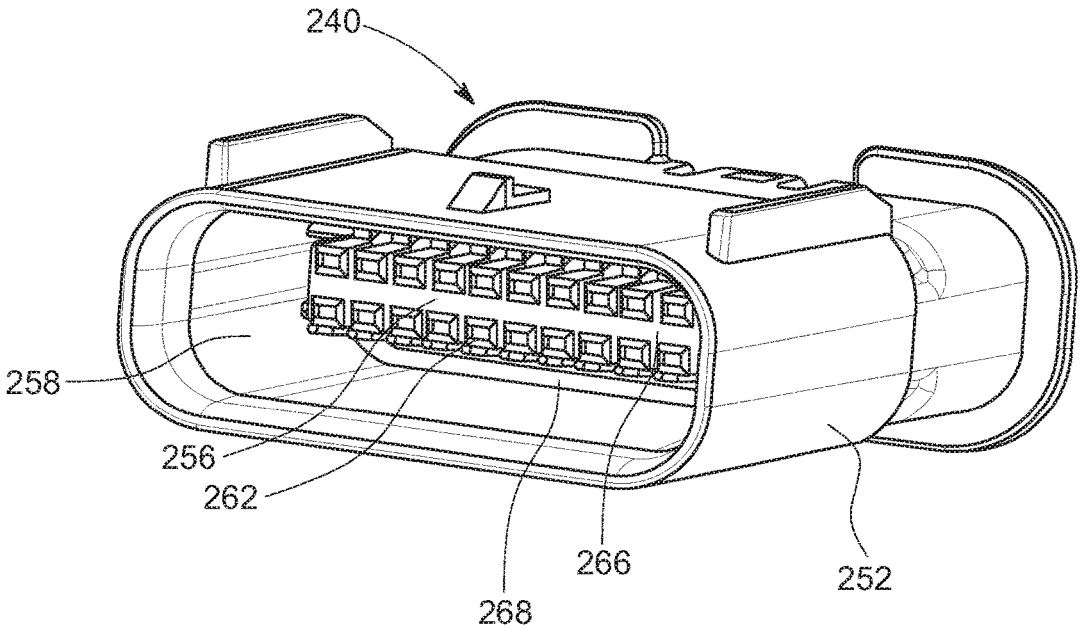
FIG. 27 is a front perspective view of an outer housing of the second connector assembly of FIG. 24.
Figure 28:
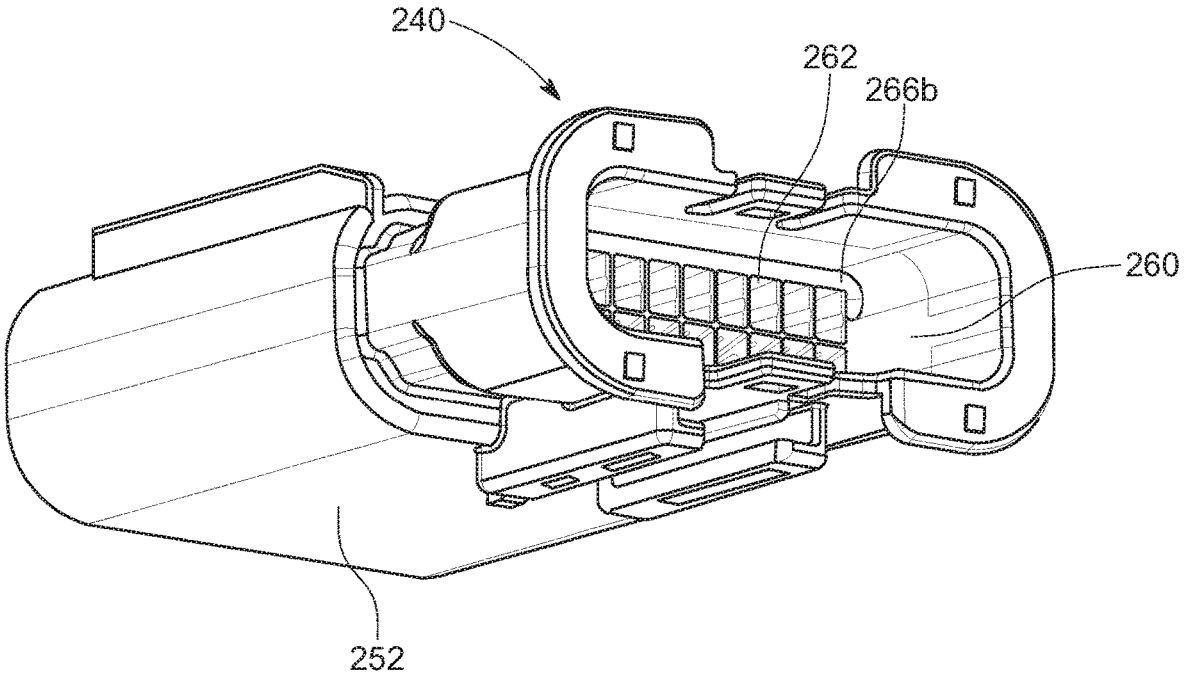
FIG. 28 is a rear perspective view of the outer housing of FIG. 27.
Figure 29:
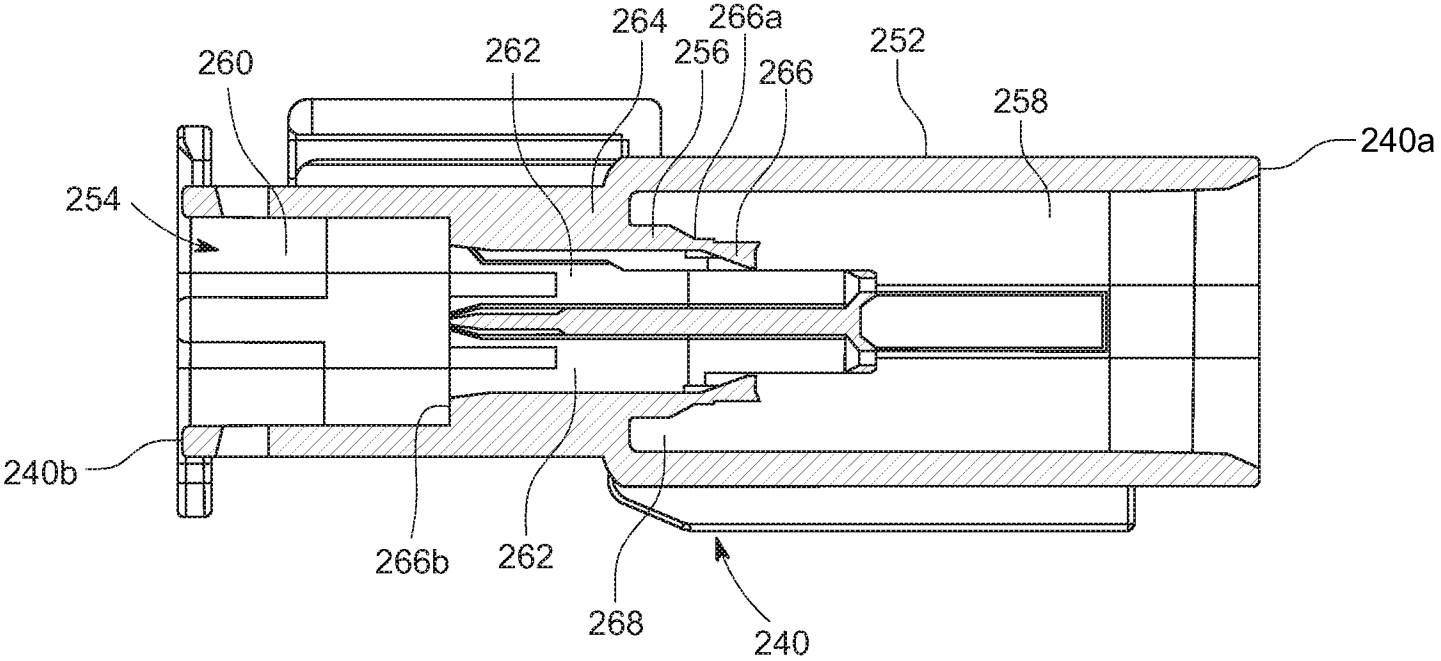
FIG. 29 is a cross-sectional view of the outer housing of FIG. 27.

The outer housing 240, see FIGS. 27-29, is formed of an insulative material and has an outer wall 252 having an internal cavity 254 extending from a front end 240*a* of the outer housing 240 to a rear end 240*b* of the outer housing 240. An internal dividing wall 256 is provided within the outer wall 252 and separates the cavity 254 into a front cavity portion 258, a rear cavity portion 260 and a plurality of terminal receiving passageways 262 in communication with the front and rear cavity portions 258, 260 and which extend through the internal dividing wall 256. The front cavity portion 258 extends from the front end 240*a* to the dividing wall 256 and defines an open end at the front end 240*a* of the outer housing 240. The rear cavity portion 260 extends from the rear end 240*b* to the dividing wall 256 and defines an open end at the rear end 240*b* of the outer housing 240. The dividing wall 256 has a first wall portion 264 extending radially inwardly from the outer wall 252 and a second wall portion 266 extending longitudinally along the outer wall 252 such that a pocket 268 is formed between the outer wall 252 and the second wall portion 266. The second wall portion 266 has a planar rear face 266*b*. The pocket 268 forms part of the front cavity portion 258. The terminal receiving passageways 262 extend in the longitudinal direction through the second wall portion 266.

The mat seal 230 is elastomeric and is seated within the rear cavity portion 260 of the outer housing 240. and abuts against the rear face 266*b* of the second wall portion 266. The outer edge of the mat seal 230 engages, and seals, with the inner surface of the outer wall 252. The mat seal 230 is provided with a plurality of terminal receiving passageways 290 extending from a front face 230*a* to a rear 230*b* thereof. The front face 230*a* and the rear face 230*b* are planar. The terminal receiving passageways 290 align longitudinally with the terminal receiving passageways 262 through the outer housing 240.

Figure 30:
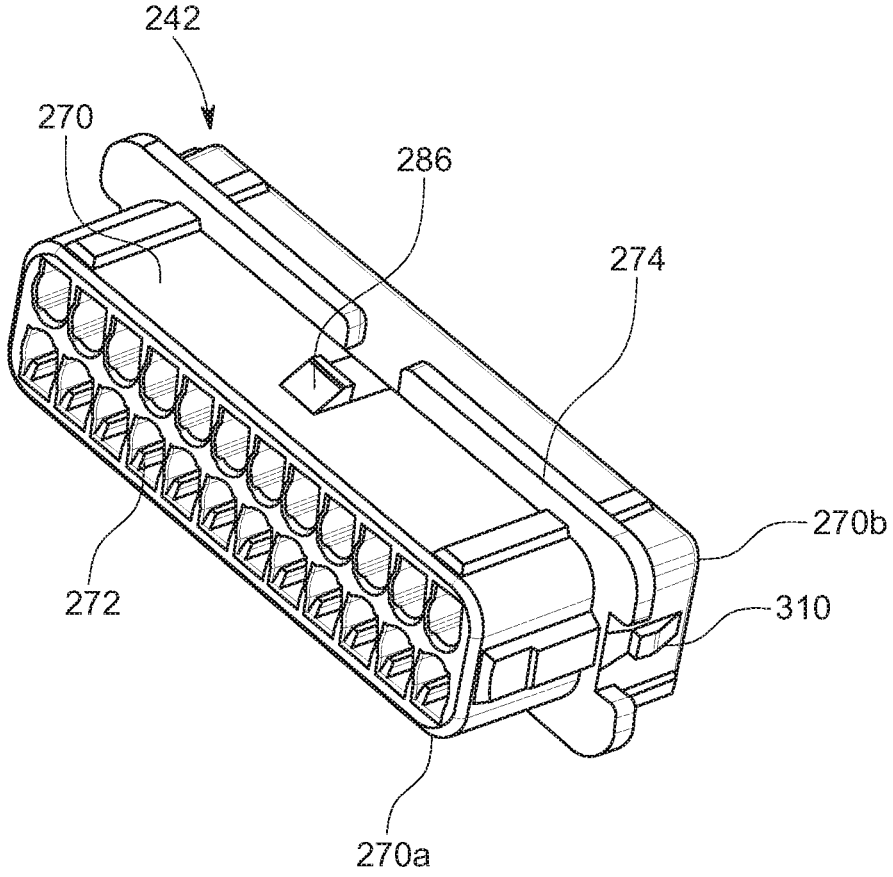
FIG. 30 is a front perspective view of a terminal housing of the second connector assembly of FIG. 24.

The terminal housing 242, see FIG. 30, is formed of an insulative material and has a wall 270 having a plurality of terminal receiving passageways 272 extending from a front face 270*a* to a rear face 270*b* thereof, and a flange 274 depending outwardly therefrom. A portion of the wall 270 which is forward of the flange 274 seats within the rear cavity portion 260 and the front face 270*a* is proximate to the rear face 230*b* of the mat seal 230. The flange 274 engages against the rear end 240*b* of the outer housing 240. The terminal housing 242 has a locking feature 286, such as a tab extending from the wall 270, which engages with a locking feature 288, such as an opening provided through the outer wall 252 of the outer housing 240, to lock the terminal housing 242 to the outer housing 240. The terminal receiving passageways 272 through the terminal housing 242 align longitudinally with the terminal receiving passageways 290, 262.

Figure 31:
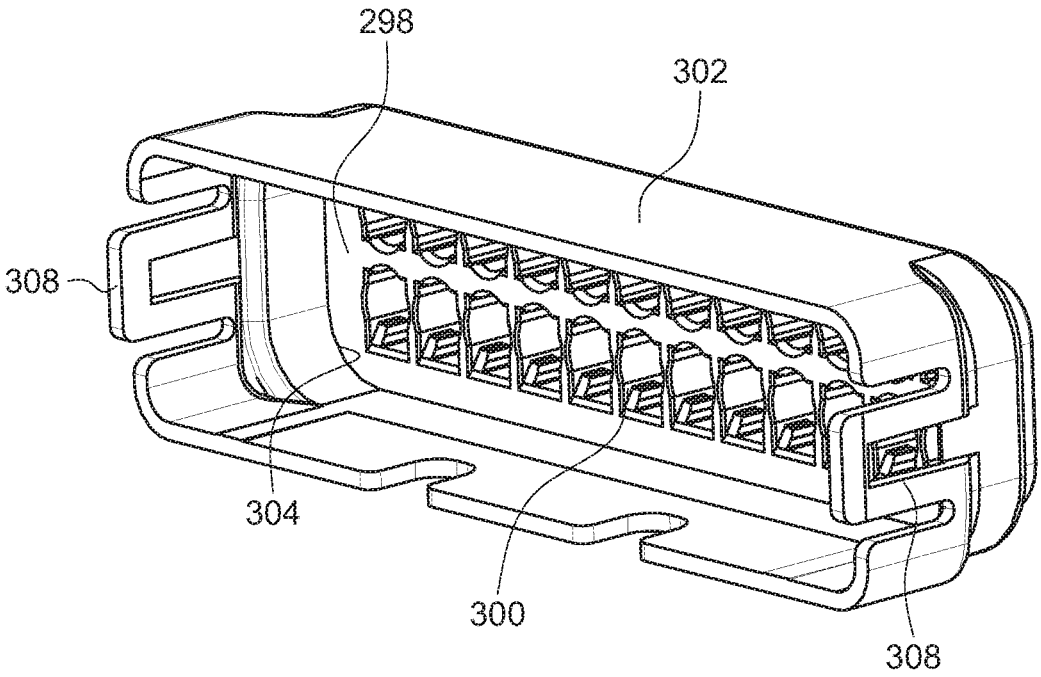
FIG. 31 is a front perspective view of a shield seal cap of the second connector assembly of FIG. 24.
Figure 32:
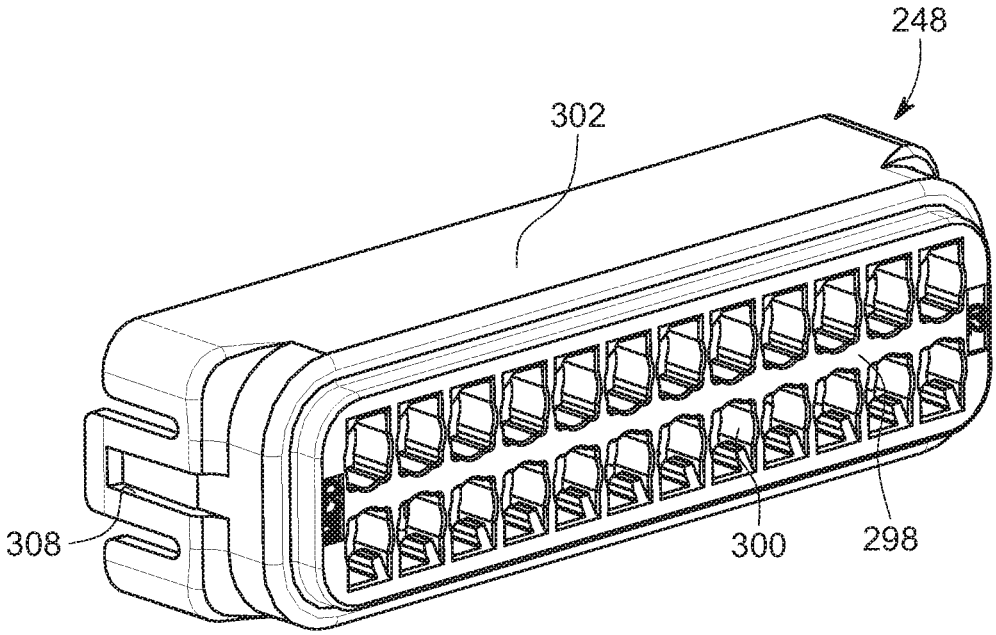
FIG. 32 is a rear perspective view of the shield seal cap of FIG. 31.
Figure 33:
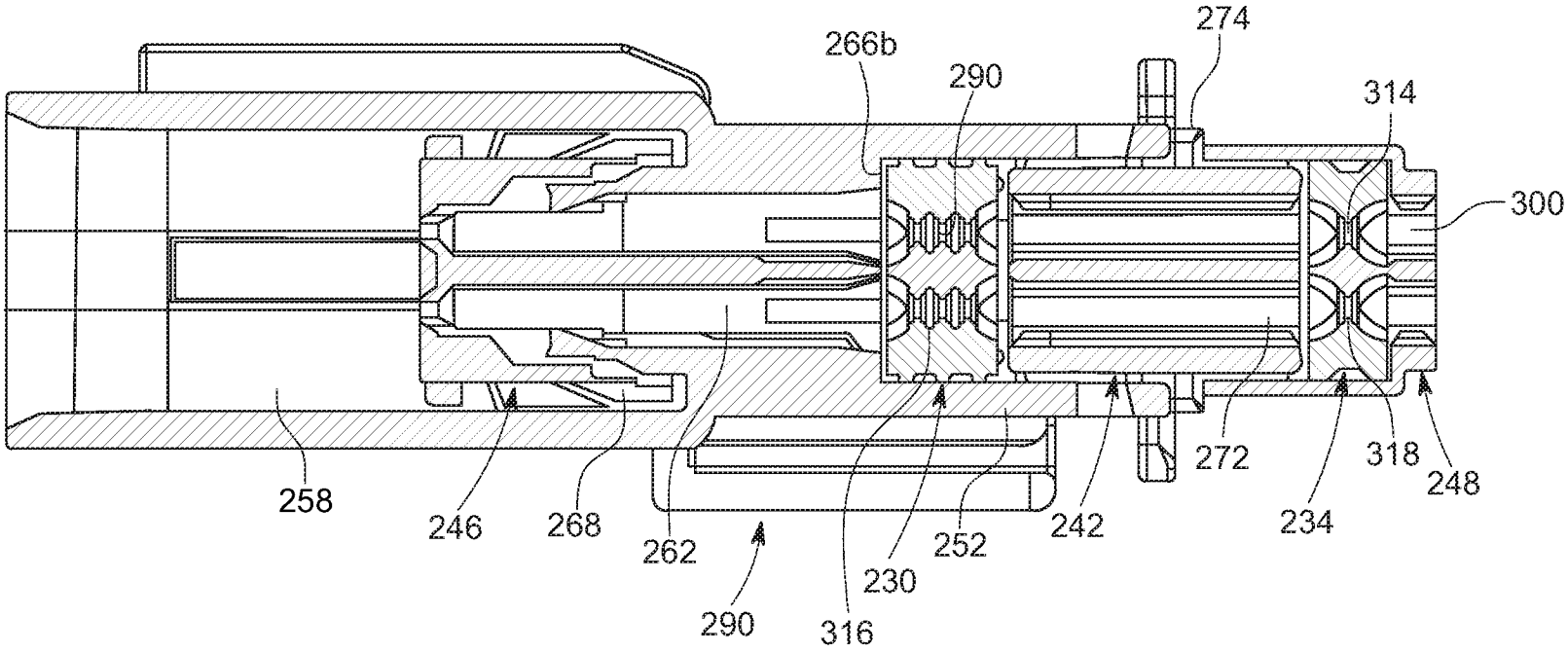
FIG. 33 is a cross-sectional view of the second connector assembly of FIG. 24.
Figure 34:
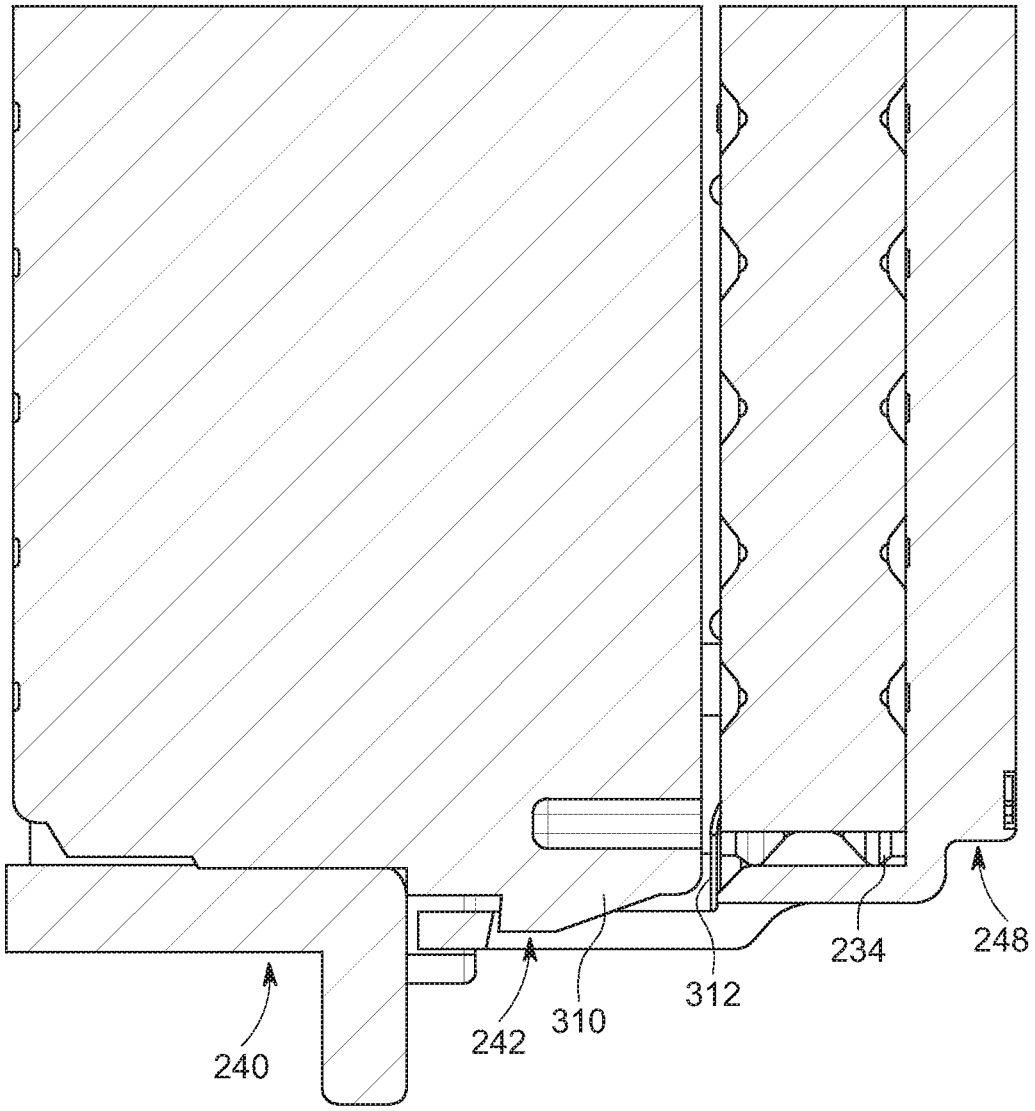
FIG. 34 is a partial cross-sectional view of the second connector assembly of FIG. 22.

The shield seal cap 248, see FIGS. 31 and 32, is formed of an insulative material and has a rear wall 298 having a plurality of terminal receiving passageways 300 therethrough and a front wall 302 depending from the rear wall 298 such that a cavity 304 having an open front end is formed. The portion of the wall 270 of the terminal housing 242 which is rearward of the flange 274 seats within the cavity 304 of the shield seal cap 248. The shield seal cap 248 has a locking feature 308, such as openings provided on flexible finger portions of the front wall 302, which engages with a locking feature 310, such as tabs, extending from the terminal housing 242 to lock the shield seal cap 248 and the terminal housing 242 together. The openings 308 through the shield seal cap 248 are larger than the tabs 310 on the terminal housing 242 such that a gap 312, see FIG. 34, is provided between the tabs 310 and the shield seal cap 248 to provide for a leak path as described herein.

The shield seal 234 is elastomeric and has a plurality of terminal receiving passageways 314 extending from a front face 234*a* to a rear face 234*b* thereof. The front face 234*a* and the rear face 234*b* are planar. The shield seal 234 is seated within the cavity 304 of the shield seal cap 248 and the outer edge of the shield seal 234 engages, and seals, with the inner surface of the front wall 302. The front face 234*a* is proximate to, but spaced from, the rear face 270*b* of the terminal housing 242. The shield seal cap 248 secures the shield seal 234 to the terminal housing 242, and in turn, to the outer housing 240. The front face 234*a* of the shield seal 234 is generally aligned with or rearward of the opening 308. The rear face 234*b* of the shield seal 234 abuts against a front face of the rear wall 298. The terminal receiving passageways 314 align longitudinally with the terminal receiving passageways 300, 272, 290, 262.

The terminal receiving passageways 300, 314, 272, 290, 262 align longitudinally with each other and wire terminated electrical terminals (not shown) extend through predetermined ones of the aligned terminal receiving passageways 300, 314, 272, 290, 262 (unused ones are plugged by plugs (not shown) extending from the terminal housing 242). The terminal housing 242 guides the terminals into the terminal receiving passageways 290 of the mat seal 230. Each terminal receiving passageway 290 in the mat seal 230 and each terminal receiving passageway 314 in the shield seal 234 includes at least one lobe which is compressed against the terminal when the terminal extends therethrough. As shown, the mat seal 230, which is the primary seal, has three lobes 316, but only two lobes may be provided, or more than three lobes may be provided. The shield seal 234, which is the secondary seal, has a single lobe 318, but more than one lobe 318 may be provided. Each lobe 316, 318 is compressed against the terminal when the terminal extends therethrough to provide a seal against the terminal.

A leak path is thus provided between the front face 234*a* of the shield seal 234 and the rear end 242*b* of the terminal housing 242 and through the mating locking features 308, 310 of the shield seal cap 248 and the terminal housing 242.

While the shield seal 234 is shown seated in the shield seal cap 248 and the shield seal cap 248 is connected to the terminal housing 242 which is in turn connected to the outer housing 240, a configuration similar to that shown in FIGS. 15-23 for the second embodiment of the first connector assembly 122 can be provided, with the mat seal 230, the terminal housing 242, the shield seal 234 seated within the second cavity of the outer housing 240, and the shield seal cap 248 attached to the outer housing 240.

The primary lock reinforcement 246 is seated in the front cavity portion 258 of the outer housing 240, and engages with the front end 266*a* of the dividing wall 256 of the outer housing 240. The primary lock reinforcement 246 has a plurality of terminal receiving passageways 292 provided therethrough to allow the terminals to pass therethrough. The terminal receiving passageways 292 align longitudinally with the terminal receiving passageways 300, 314, 272, 290, 262. The primary lock reinforcement 246 may have a locking feature, such as tabs provided on flexible finger portions, which engages with a locking feature, such as a pair of recesses in the outer housing 240 to lock the primary lock reinforcement 246 with the outer housing 240. An end of the primary lock reinforcement 246 is spaced from the front end 240*a* of the outer wall of the outer housing 240.

When a high-pressure spray (pressure of 90 bar spraying the second connector assembly 24 at approximately a distance of 100 mm) of liquid is directed at the rear end 240*b* of the outer housing 240 which forms a rear end of the second connector assembly 24, the liquid passes into the terminal receiving passageways 314 of the shield seal cap 248 and between the terminal and the lobe 318 of the shield seal 234 since the liquid is under high pressure. As the liquid passes therethrough, the pressure of the liquid spray decreases such that any liquid that subsequently passes through the terminal receiving passageways 272 of the terminal housing 242 and engages the lobes 316 of the mat seal 230 is reduced sufficiently such that the liquid does not pass between the terminals and the lobes 316 of the mat seal 230. Also, the liquid drains out of the second connector assembly 24 through the leak path.

To form the sealed electrical connector system 20, the front end 24*a* of the second connector assembly 24 is inserted into the front end 22*a*, 122*a* of the first connector assembly 22 by inserting the outer wall 252 of the outer housing 240 of the second connector assembly 24 into the front cavity portion 58, 158 of the outer housing 40, 140 of the first connector assembly 22, 122. The primary lock reinforcements 46, 246 abut against each other. The ring seal 44 sealingly engages the inner wall 254 of the outer housing 240 for contributing to environmental sealing of the electrical connector system 20. The connector position assurance device 50, 150 (if provided) engages with the outer housing 40, 140 of the first connector assembly 22, 122 and the outer housing 240 of the second connector assembly 24 to mate the connector assemblies, 22, 122, 24 together. The terminal receiving passageways 72, 90, 62, 114, 100 through the first connector assembly 22 align longitudinally with the terminal receiving passageways 292, 262, 290, 272, 314, 300 through the second connector assembly 24 when the connector assemblies, 22, 122, 24 are mated together.

Terminals (not shown) extend through the aligned terminal receiving passageways 72, 90, 62, 114, 100, 292, 262, 290, 272, 314, 300. The lobes 116, 216, 316 of the mat seals 30, 130, 230 are compressed when engaged with the terminals and the lobes 118, 218, 318 of the shield seals 34, 134, 234 are compressed when engaged with the terminals.

When a high-pressure spray of liquid (pressure of 90 bars spraying the assemblies 22, 122, 24 at approximately a distance of 100 mm) is directed at either rear end 22*b*, 122*b*, 24*b* of the sealed electrical connector system 20, the liquid passes into the terminal receiving passageways 114, 214, 314 of the shield seal cap 48, 148, 248 and between the terminal and the lobe 118, 218, 318 of the shield seal 34, 134, 234 since the liquid is under high pressure. As the liquid passes therethrough, the pressure of the liquid spray decreases such that any liquid that subsequently passes through and engages the lobes 116, 216, 316 of the mat seal 30, 130, 230 is reduced sufficiently such that the liquid does not pass between the terminals and the lobes 116, 216, 316 of the mat seal 30, 130, 230. Also, the liquid drains out of the electrical connector system 20 through the leak path as described herein.

Figure 35:
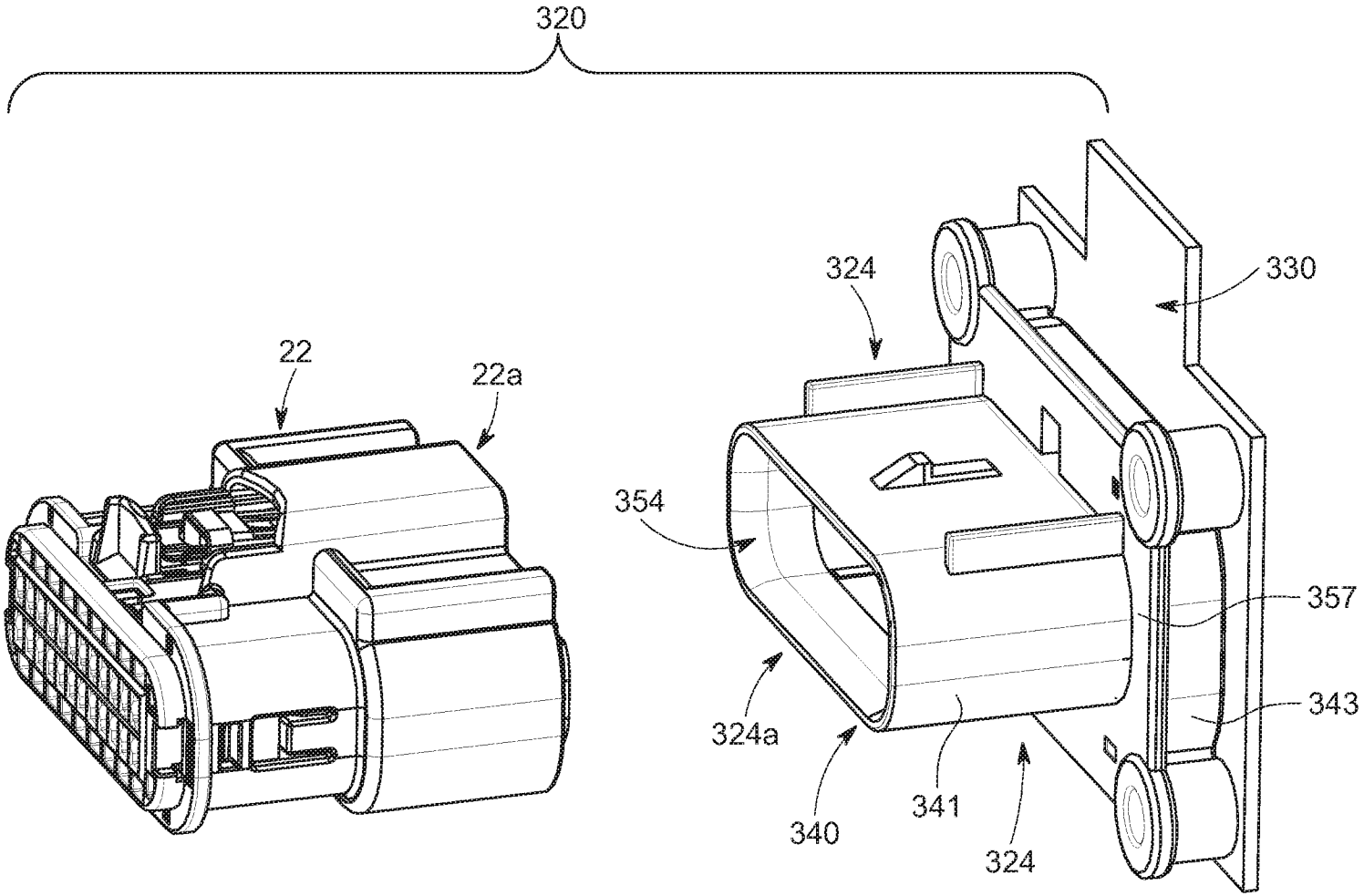
FIG. 35 is an exploded perspective view of an alternate electrical connector system having first and second connector assemblies, viewed from a rear end of one of the connector assemblies.
Figure 36:
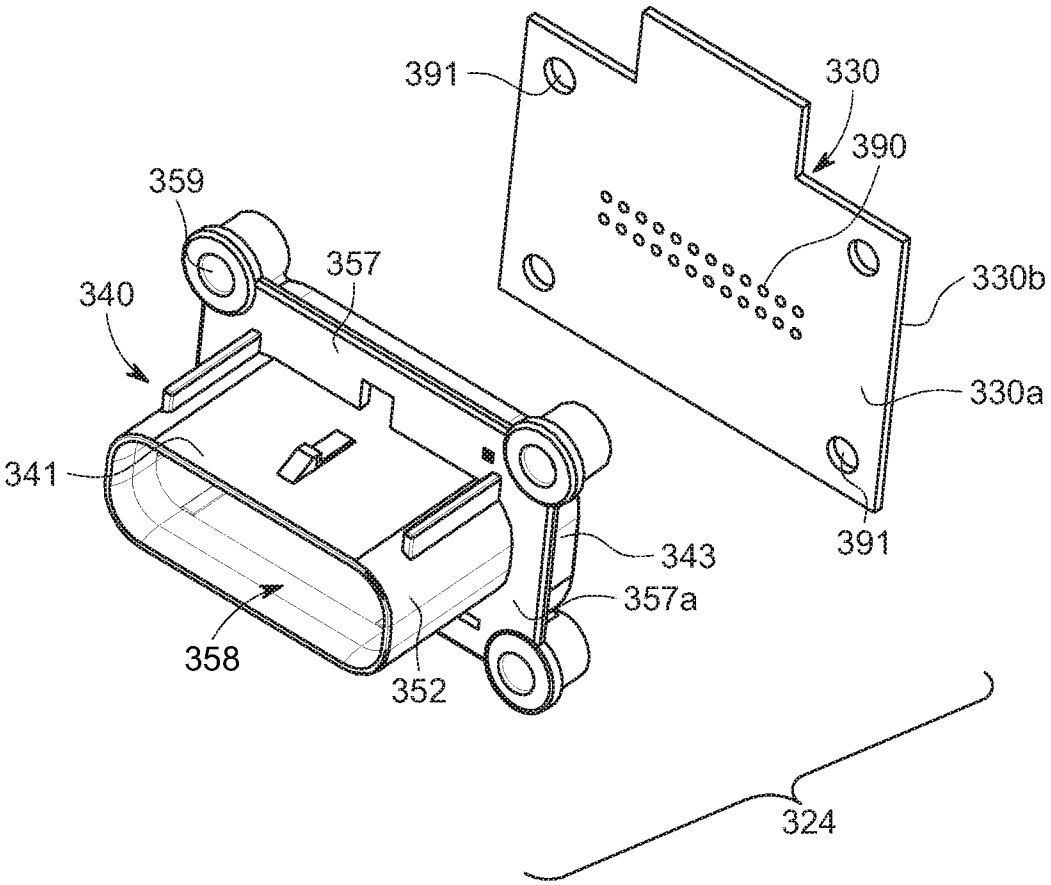
FIG. 36 is an exploded, rear perspective view of the second connector assembly of FIG. 35.
Figure 37:
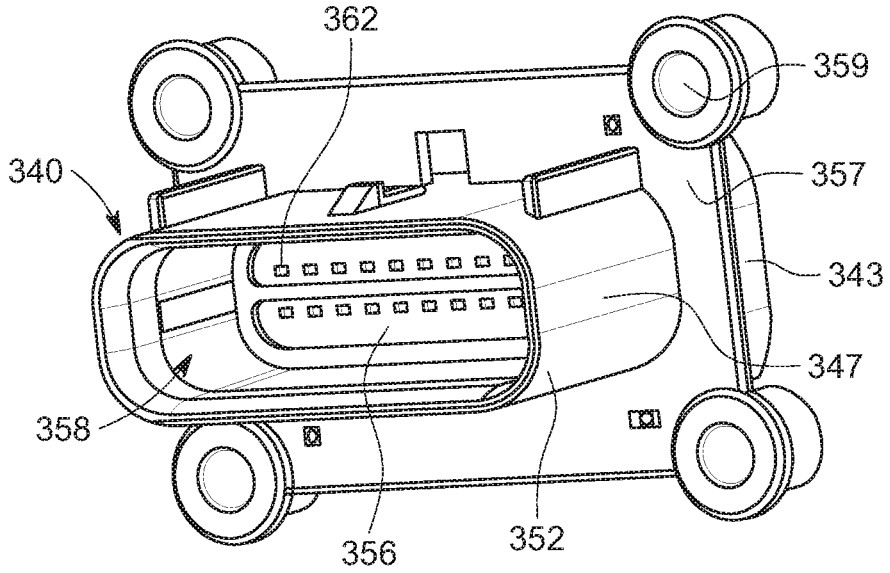
FIG. 37 is a rear perspective view of an outer housing of the second connector assembly of FIG. 36.
Figure 38:
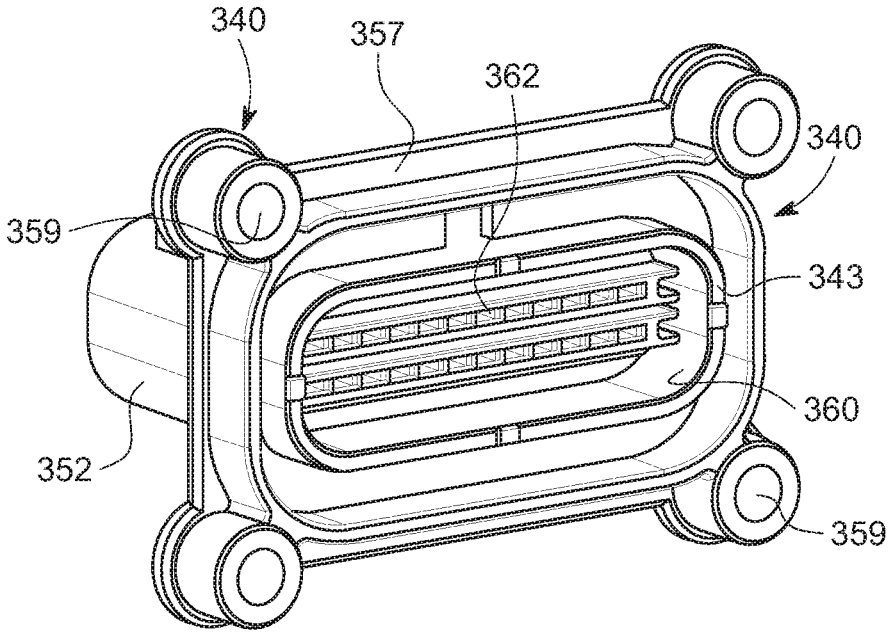
FIG. 38 is a front perspective view of the outer housing of FIG. 37.
Figure 39:
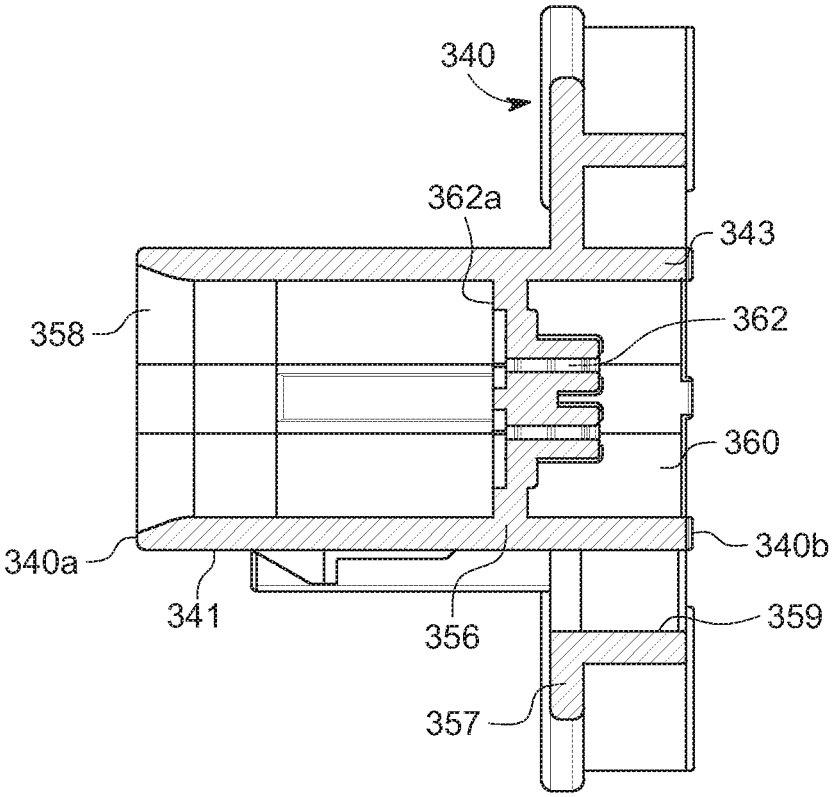
FIG. 39 is a cross-sectional view of the outer housing of FIG. 37.

Attention is now invited to the second connector assembly 324 used in the second configuration with the first connector assembly 22, 122 shown in FIGS. 35-39. FIG. 35 shows an embodiment of the second connector assembly 324 with the first connector assembly 22; the second connector assembly 324 can be equally used with the first connector assembly 122. In this instance, the second connector assembly 324 illustrates the mating interface configuration for proper connection between the first connector assembly 22 and all embodiments of the second connector assembly 324. The second connector assembly 324 includes an outer housing 340 including a mounting portion that is configured to be secured to a peripheral electronic device (not shown). In this arrangement a seal (not shown) is disposed between the outer housing 340 and an enclosure/housing (not shown) of the electronic device. The seal is sealingly engaged with the enclosure which houses a printed wiring board 330 therein.

The outer housing 340 is formed of an insulative material and has an outer wall 352 having an internal cavity 354 extending from a front end 340*a* of the outer housing 340 to a rear end 340*b* of the outer housing 340. An internal dividing wall 356 is provided within the outer wall 352 and separates the cavity 354 into a front cavity portion 358, a rear cavity portion 360 and a plurality of terminal receiving passageways 362 in communication with the front and rear cavity portions 358, 360 and which extend through the internal dividing wall 356. The front cavity portion 358 extends from the front end 340*a* to the dividing wall 356 and defines an open end at the front end 340*a* of the outer housing 340. The rear cavity portion 360 extends from the rear end 340*b* to the dividing wall 356 and defines an open end at the rear end 340*b* of the outer housing 340. The dividing wall 356 has a planar front face 356*a*. The terminal receiving passageways 362 extend in the longitudinal direction through the dividing wall 356. In the embodiment shown, a flange 357 extends outwardly from the outer wall 352 and has a plurality of mounting features 359, such as openings therein, which receives a securing feature (not shown), such fasteners, which engages therewith, and fastens the outer housing 340 to the enclosure. The flange 357 divides the outer wall 352 into a front portion 341 which extends from the front end 340*a* of the outer housing 340 to the flange 357 and a rear 343 which extends from the rear end 340*b* of the outer housing 340 to the flange 357.

As previously mentioned, the seal (not shown) is elastomeric and is seated between the outer housing 340 and the enclosure. Typically the seal is positioned between the rear end 340*b* of the outer housing 340 and the enclosure to seal the outer housing 340 to the enclosure. In an alternate embodiment, the seal has an opening through which the front portion 351 of the outer wall 352 extends and the seal engages against a front face 357*a* of the flange 357. The seal engages an inner surface of the enclosure such that the seal, the flange 357 and the rear portion 353 of the outer housing 340 are within the enclosure. The front portion 351 extends through an opening (not shown) in the enclosure. In an embodiment as shown, the printed wiring board 330 has a plurality of terminal receiving vias 390 extending from a front face 330*a* to a rear face 330*b* thereof, and a plurality of fastener receiving passageways 391 extending from the front face 330*a* to the rear face 330*b* thereof. The front face 330*a* and the rear face 330*b* are planar. With the embodiment of the printed wiring board 330 shown in FIG. 36, the terminal receiving vias 390 align longitudinally with the terminal receiving passageways 362 through the outer housing 340, and the fastener receiving passageways 391 align longitudinally with the locking features 359.

To form the sealed electrical connector system 320, the front end 324*a* of the second connector assembly 324 is inserted into the front end 22*a* or 122*a* of the first connector assembly 22 by inserting the outer wall 352 of the outer housing 340 of the second connector assembly 324 into the front cavity portion 58 or 158 of the outer housing 40 or 140 of the first connector assembly 22 or 122. The primary lock reinforcements 46 abut against the front face 356*a* of the dividing wall 356. The ring seal 44 sealingly engages the inner wall 354 of the outer housing 340 for contributing to environmental sealing of the electrical connector system 320. The connector position assurance device 50, 150 (if provided) engages with the outer housing 40 or 140 of the first connector assembly 22 or 122 and the outer housing 340 of the second connector assembly 324 to mate the connector assemblies, 22 or 122, 324 together. The terminal receiving passageways 72, 90, 62, 114, 100 through the first connector assembly 22 align longitudinally with the terminal receiving vias 390 (and terminal receiving passageways 362 if provided) through the second connector assembly 224 when the connector assemblies, 22 or 122, 224 are mated together.

Terminals (not shown) extend through the aligned terminal receiving passageways and vias 72, 90, 62, 114, 100, 390 respectively (and terminal receiving passageways 362 if provided), and through terminal receiving passageways in the enclosure. The terminals are then routed through the enclosure for mating with the printed wiring board. The lobes 116, 216 of the mat seal 30 or 130 are compressed when engaged with the terminals and the lobes 118 or 218 of the shield seals 34 or 134 are compressed when engaged with the terminals.

When a high-pressure spray of liquid (pressure of 90 bar spraying the assemblies 22, 122, 24 at approximately a distance of 100 mm) is directed at the rear end 22*b* or 122*b* of the first connector assembly 22 or 122, the liquid passes into the terminal receiving passageways 114 or 214 of the shield seal cap 48 or 148 and between the terminal and the lobe 118 or 218 of the shield seal 34 or 134 since the liquid is under high pressure. As the liquid passes therethrough, the pressure of the liquid spray decreases such that any liquid that subsequently passes through and engages the lobes 116 or 216 of the mat seal 30 or 130 is reduced sufficiently such that the liquid does not pass between the terminals and the lobes 116 or 216 of the mat seal 30 or 130. Also, the liquid drains out of the electrical connector system 320 through the leak path of the first connector assembly 22 or 122 as described herein.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector assembly comprising:

an insulative outer housing having a front end and an opposite rear end, and having a cavity defined therebetween;

an insulative shield seal cap defining a plurality of terminal receiving passageways, the shield seal cap being attached to the rear end of the outer housing;

an elastomeric shield seal having a plurality of terminal receiving passageways therethrough, the shield seal being attached to the outer housing adjacent to the shield seal cap;

an insulative terminal housing defining a plurality of terminal receiving passageways, the terminal housing being mounted within the cavity of the outer housing; and an elastomeric mat seal mounted in the cavity of the outer housing, the mat seal having a plurality of terminal receiving passageways therethrough, the mat seal being adjacent to the terminal housing, wherein the terminal receiving passageways are aligned with each other.

2. The connector assembly as defined in claim 1, the shield seal cap defines a cavity and the plurality of terminal receiving passageways of the shield seal cap are in communication with the cavity of the shield seal cap, and wherein the shield seal is mounted in the cavity of the shield seal cap.

3. The connector assembly as defined in claim 2, wherein the shield seal cap is releasably locked to the terminal housing.

4. The connector assembly as defined in claim 3, wherein the terminal housing is releasably locked to the outer housing.

5. The connector assembly as defined in claim 4, wherein the shield seal cap further includes an opening therethrough proximate to the shield seal to provide a leak path for fluid.

6. The connector assembly as defined in claim 4, wherein the outer housing has an internal dividing wall which separates the cavity of the outer housing into a front cavity portion extending from the front end of the outer housing to the internal dividing wall, a rear cavity portion extending from the rear end of the outer housing to the internal dividing wall, and a plurality of terminal receiving passageways between the cavity portions and in communication with the cavity portions, wherein the shield seal cap and the shield seal are mounted in the rear cavity portion, and the terminal housing and the mat seal are mounted in the front cavity portion.

7. The connector assembly as defined in claim 6, wherein the shield seal cap further includes an opening therethrough proximate to the shield seal to provide a leak path for fluid.

8. The connector assembly as defined in claim 4, wherein the outer housing has an internal dividing wall which separates the cavity of the outer housing into a front cavity portion extending from the front end of the outer housing to the internal dividing wall, a rear cavity portion extending from the rear end of the outer housing to the internal dividing wall, and a plurality of terminal receiving passageways between the cavity portions and in communication with the cavity portions, wherein the mat seal, the terminal housing, the shield seal and the shield seal cap are mounted in the rear cavity portion.

9. The connector assembly as defined in claim 8, wherein the outer housing further includes an opening therethrough proximate to the shield seal to provide a leak path for fluid.

10. The connector assembly as defined in claim 1, wherein the shield seal cap is releasably locked to the outer housing.

11. The connector assembly as defined in claim 10, wherein the outer housing further includes an opening therethrough proximate to the shield seal to provide a leak path for fluid.

12. The connector assembly as defined in claim 10, wherein the outer housing has an internal dividing wall which separates the cavity of the outer housing into a front cavity portion extending from the front end of the outer housing to the internal dividing wall, a rear cavity portion extending from the rear end of the outer housing to the internal dividing wall, and a plurality of terminal receiving passageways between the cavity portions and in communication with the cavity portions, wherein the shield seal cap and the shield seal are mounted in the rear cavity portion, and the terminal housing and the mat seal are mounted in the front cavity portion.

13. The connector assembly as defined in claim 12, wherein the outer housing further includes an opening therethrough proximate to the shield seal to provide a leak path for fluid.

14. The connector assembly as defined in claim 10, wherein the outer housing has an internal dividing wall which separates the cavity of the outer housing into a front cavity portion extending from the front end of the outer housing to the internal dividing wall, a rear cavity portion extending from the rear end of the outer housing to the internal dividing wall, and a plurality of terminal receiving passageways between the cavity portions and in communication with the cavity portions, wherein the mat seal, the terminal housing, the shield seal and the shield seal cap are mounted in the rear cavity portion.

15. The connector assembly as defined in claim 1, wherein the outer housing further includes an opening therethrough proximate to the shield seal to provide a leak path for fluid.

16. The connector assembly of claim 1 in combination with a second connector assembly, the second connector assembly comprising:

a second insulative outer housing having a front end and an opposite rear end, and having a cavity defined therebetween;

a second insulative shield seal cap defining a plurality of terminal receiving passageways, the second shield seal cap being attached to the rear end of the second outer housing;

a second elastomeric shield seal having a plurality of terminal receiving passageways therethrough, the second shield seal being attached to the second outer housing adjacent to the second shield seal cap;

a second insulative terminal housing defining a plurality of terminal receiving passageways, the second terminal housing being mounted within the cavity of the second outer housing; and a second elastomeric mat seal mounted in the cavity of the second outer housing, the second mat seal having a plurality of terminal receiving passageways therethrough, the second mat seal being adjacent to the second terminal housing, wherein the terminal receiving passageways of the second outer housing, the second shield seal cap, the second shield seal, the second terminal housing and the second mat seal are aligned with each other, wherein front ends of the first-defined connector assembly and the second connector assembly mate with each other, and the terminal receiving passageways of the first-defined connector assembly and the terminal receiving passageways of the second connector assembly align with each other.

17. The combination of claim 16, wherein the first-defined connector assembly further comprises an internal dividing wall in the outer housing which separates the cavity of the outer housing into a front cavity portion extending from the front end of the outer housing to the internal dividing wall, a rear cavity portion extending from the rear end of the outer housing to the internal dividing wall, and a plurality of terminal receiving passageways between the cavity portions and in communication with the cavity portions, the shield seal cap and the shield seal are mounted in the rear cavity portion, and the terminal housing and the mat seal are mounted in the front cavity portion; and wherein the second connector assembly further comprises an internal dividing wall in the outer housing which separates the cavity of the outer housing into a front cavity portion extending from the front end of the outer housing to the internal dividing wall, a rear cavity portion extending from the rear end of the outer housing to the internal dividing wall, and a plurality of terminal receiving passageways between the cavity portions and in communication with the cavity portions, the terminal housing, the mat seal, the shield seal and the shield seal cap are mounted in the rear cavity portion.

18. The combination of claim 17, wherein the shield seal of at least one of the connector assemblies is mounted in a cavity of the shield cap.

19. The combination of claim 16, wherein the first-defined connector assembly further comprises an internal dividing wall in the outer housing which separates the cavity of the outer housing into a front cavity portion extending from the front end of the outer housing to the internal dividing wall, a rear cavity portion extending from the rear end of the outer housing to the internal dividing wall, and a plurality of terminal receiving passageways between the cavity portions and in communication with the cavity portions, the terminal housing, the mat seal, the shield seal and the shield seal cap are mounted in the rear cavity portion; and wherein the second connector assembly further comprises an internal dividing wall in the outer housing which separates the cavity of the outer housing into a front cavity portion extending from the front end of the outer housing to the internal dividing wall, a rear cavity portion extending from the rear end of the outer housing to the internal dividing wall, and a plurality of terminal receiving passageways between the cavity portions and in communication with the cavity portions, the terminal housing, the mat seal, the shield seal and the shield seal cap are mounted in the rear cavity portion.

20. The combination of claim 19, wherein the shield seal of at least one of the connector assemblies is mounted in a cavity of the shield cap.

* * * * *